US011390513B2

(12) United States Patent
Walton et al.

(10) Patent No.: US 11,390,513 B2
(45) **Date of Patent: *Jul. 19, 2022**

(54) APPARATUS FOR DISPENSING A LIQUID FROM A LIQUID STORAGE CONTAINER

(71) Applicant: Cardomon International Limited, Kowlon (HK)

(72) Inventors: Philip A. Walton, Bishop Auckland (GB); Stephen James Vipond, Eaglescliffe (GB); Dennis Laurier Rivard, Alberta (CA); Tyler Wayne Nickerson, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/074,704

(22) Filed: Oct. 20, 2020

(65) Prior Publication Data

US 2021/0070600 A1 Mar. 11, 2021

Related U.S. Application Data

(63) Continuation of application No. 16/254,692, filed on Jan. 23, 2019, now Pat. No. 10,807,854, which is a (Continued)

(51) Int. Cl.
*B67D 1/00* (2006.01)
*B67D 1/07* (2006.01)

(Continued)

(52) U.S. Cl.
CPC ..... *B67D 1/07* (2013.01); *B67D 1/0009* (2013.01); *B67D 1/0016* (2013.01); *B67D 1/10* (2013.01); *B67D 1/125* (2013.01); *B67D 3/0038* (2013.01); *B65B 3/04* (2013.01); *B65D 35/28* (2013.01); *B65D 83/00* (2013.01); *B67D 1/00* (2013.01);

(Continued)

(58) Field of Classification Search
CPC . B67D 1/07; B67D 1/10; B67D 1/125; B67D 3/0038; B67D 1/0016; B67D 1/0009; B67D 2210/00034; B67D 1/0801; B67D 2001/075; B67D 7/58; B67D 1/00; B67D 2210/0006; B65B 3/04; E03B 7/077; E03B 7/12; B65D 83/00; B65D 35/28; Y10T 137/85978
See application file for complete search history.

(56) References Cited

U.S. PATENT DOCUMENTS 3,698,603 A * 10/1972 Radcliffe ..... B67D 3/0038 222/146.1
3,904,116 A * 9/1975 Jones ..... B05B 9/0866 239/127

(Continued)

*Primary Examiner* — Frederick C Nicolas
(74) *Attorney, Agent, or Firm* — Merek, Blackmon & Voorhees, LLC

(57) ABSTRACT

A removable liquid transport assembly configured to be readily installed in and removed from a liquid dispenser to permit the liquid dispenser to be readily sanitized. The removable liquid transport assembly preferably includes a liquid manifold, a valve assembly and a pump head. The removable liquid transport assembly is configured such that liquid can flow in a first direction through the removable liquid transport assembly to permit a liquid to be dispensed from a liquid dispenser and liquid can flow in a second direction back to a liquid storage container to prevent damage to one or more components of the liquid dispenser.

13 Claims, 22 Drawing Sheets

Related U.S. Application Data continuation of application No. 15/388,429, filed on Dec. 22, 2016, now Pat. No. 10,202,270, which is a continuation of application No. 13/373,886, filed on Dec. 5, 2011, now Pat. No. 9,527,714, which is a continuation-in-part of application No. 13/137,606, filed on Aug. 29, 2011, now Pat. No. 8,887,955.

(51) Int. Cl.

| | |
|---|---|
| ***B67D 1/10*** | (2006.01) |
| ***B67D 1/12*** | (2006.01) |
| ***B67D 3/00*** | (2006.01) |
| *B65B 3/04* | (2006.01) |
| *E03B 7/07* | (2006.01) |
| *B65D 83/00* | (2006.01) |
| *B65D 35/28* | (2006.01) |
| *B67D 7/58* | (2010.01) |
| *E03B 7/12* | (2006.01) |
| *B67D 1/08* | (2006.01) |

(52) U.S. Cl.

CPC ..... *B67D 1/0801* (2013.01); *B67D 7/58* (2013.01); *B67D 2001/075* (2013.01); *B67D 2210/0006* (2013.01); *B67D 2210/00034* (2013.01); *E03B 7/077* (2013.01); *E03B 7/12* (2013.01); *Y10T 137/85978* (2015.04)

(56) References Cited

U.S. PATENT DOCUMENTS 5,361,942 A * 11/1994 Salkeld ..... B67D 3/00 222/105
5,495,725 A * 3/1996 Middlemiss ..... B67D 1/04 141/198
5,540,355 A * 7/1996 Hancock ..... B67D 1/04 222/146.6
5,573,142 A * 11/1996 Morellato ..... B01D 61/08 222/129.1
5,979,709 A * 11/1999 Liccioni ..... B67D 3/0009 222/185.1
6,868,986 B1 * 3/2005 Arnold ..... B67D 1/0009 222/146.6
6,959,836 B2 * 11/2005 Collasius ..... G01N 1/38 222/1
7,062,937 B1 * 6/2006 Baker ..... B67D 1/0868 222/146.6
7,111,762 B2 * 9/2006 Saunders ..... G01F 11/029 222/333
7,131,556 B2 * 11/2006 Tseng ..... B67D 1/0431 222/64
7,458,388 B2 * 12/2008 Huang ..... E03B 7/10 137/218
7,556,064 B2 * 7/2009 Tyler ..... B67D 3/0029 138/30
7,669,738 B1 * 3/2010 Byers ..... B67D 1/0004 222/164
7,878,372 B1 * 2/2011 Camejo ..... B67D 3/0093 222/64
8,292,126 B2 * 10/2012 Pittaway ..... B67D 3/0029 222/185.1
8,887,955 B2 * 11/2014 Walton ..... B67D 1/10 222/67
9,527,714 B2 * 12/2016 Walton ..... B67D 1/07
10,202,270 B2 * 2/2019 Walton ..... B67D 1/07
10,807,854 B2 * 10/2020 Walton ..... B67D 1/125
2005/0072813 A1 * 4/2005 Walton ..... B67D 1/0872 222/464.3
2007/0278250 A1 * 12/2007 Pittaway ..... B67D 3/0029 222/185.1
2010/0252585 A1 * 10/2010 Yui ..... B67D 1/0895 222/400.7
2011/0303701 A1 * 12/2011 Algora ..... B67D 3/0009 222/185.1

* cited by examiner

APPARATUS FOR DISPENSING A LIQUID FROM A LIQUID STORAGE CONTAINER

RELATED APPLICATIONS

The subject patent application is a continuation of U.S. patent application Ser. No. 15/388,429 filed on Dec. 22, 2016 which is a continuation of U.S. patent application Ser. No. 13/373,886 filed on Dec. 5, 2011, now U.S. Pat. No. 9,527,714, which is a continuation-in-part of U.S. patent application Ser. No. 13/137,606 filed on Aug. 29, 2011, now U.S. Pat. No. 8,887,955. Priority is claimed under 35 USC § 120 from U.S. patent application Ser. No. 15/388,429, U.S. patent application Ser. No. 13/373,886 and U.S. patent application Ser. No. 13/137,606. The entire contents of U.S. patent application Ser. Nos. 15/388,429, 13/137,606 and 13/373,886 are incorporated herein by reference.

FIELD OF THE INVENTION

The present invention is directed to a dispensing apparatus for dispensing liquid from a liquid storage container and a replaceable liquid transport assembly for conveying liquid between a liquid storage container and a dispensing location of the dispensing apparatus. The dispensing apparatus may dispense any suitable liquid including but not limited to chilled drinking water, hot water, ambient temperature drinking water, carbonated liquid and/or any combination thereof. The liquid storage container may include but is not limited to a replaceable five (5) gallon water bottle stored in a lower portion of the dispensing apparatus. In its most preferred form, the present invention is directed to a water cooler for dispensing at least chilled drinking water from a replaceable five (5) gallon water bottle stored in a lower portion of the water cooler in an upright orientation.

BACKGROUND OF THE INVENTION

A significant number of existing water dispensers use gravity as the driving force to dispense water from the water dispenser. In this type of water dispenser, the water bottle is positioned above the dispensing location. These dispensers are referred to as "Top-Loading" water dispensers. Top-Loading water dispensers typically include means for receiving a five (5) gallon water bottle at the uppermost portion of the water dispenser. Five (5) gallon water bottles are quite heavy making it difficult for some individuals to mount the water bottle on the uppermost portion of the water cooler. Top-Loading water dispensers typically dispense water for human consumption. Therefore, it is important that the water contact surfaces of the water dispenser be periodically cleaned. The cleaning process is generally known as "sanitization." Top-Loading water dispensers typically are simple devices with few components in contact with the drinking water. Hence, the sanitization process is relatively easy. A number of Top-Loading water dispensers are designed to improve the sanitization process. U.S. Pat. Nos. 5,361,942 and 5,439,145 disclose Top-Loading water dispensers designed to improve the sanitization process. Ebac Limited sells Top-Loading water dispensers designed to improve the sanitization process utilizing at least some of the features disclosed in U.S. Pat. Nos. 5,361,942 and 5,439,145 including the removable manifold unit, reservoir and associated plastic or rubber tubing. This removable assembly is marketed under the Ebac Limited trademark WATERTRAIL.

To overcome the problems of Top-Loading water dispensers, water dispensers in which the water bottle is stored in the lower portion of the water dispenser have been proposed. Since these systems cannot rely upon gravity to dispense drinking water, pumps are typically employed to pump the drinking water to the dispensing location located above the water bottle. These types of water dispensers are referred to herein as "Bottom-Loading" water dispensers. An example of such a water dispenser is disclosed in U.S. Patent Publication No. 2005/0072813. Bottom-Loading water dispensers address the water bottle installation problems associated with Top-Loading water dispensers. However, Bottom-Loading water dispensers employ significantly more water contact components than Top-Loading water dispensers and, therefore, are more difficult to sanitize effectively. Ebac Limited introduced a Bottom-Loading water dispenser under the trademark EASYLOADER with a removable WATERTRAIL in an effort to make sanitization easier. However, this water dispenser was expensive to produce and has not succeeded commercially.

Therefore, there is a significant need for a Bottom-Loading liquid dispenser that can be readily and easily sanitized while also being relatively inexpensive to manufacture. There is also a significant need for a simplified removable liquid transport assembly that conveys liquid between a liquid storage container, one or more reservoirs and a dispensing nozzle or nozzles of the liquid dispenser that can be manufactured at a relatively low cost and can be readily removed and replaced to ensure effective sanitization of the liquid dispenser.

OBJECTS AND SUMMARY OF THE INVENTION

An object of the present invention is to provide a novel and unobvious apparatus for dispensing liquid from a liquid storage container.

Another object of a preferred embodiment of the present invention is to provide a Bottom-Loading water dispenser that is relatively inexpensive to produce and is also easy to sanitize in a very short period of time.

Still another object of a preferred embodiment of the present invention is to provide a removable liquid transport assembly that is relatively inexpensive to manufacture while allowing for effective sanitization of the water dispenser.

A further object of a preferred embodiment of the present invention is to provide a removable liquid transport assembly configured to reduce the number of components thereof including the number of flexible hoses or conduits associated therewith.

Yet another object of a preferred embodiment of the present invention is to provide a Bottom-Loading water dispenser that requires only a single pump to pump water from a liquid storage container to one or more dispensing nozzles of a water dispenser.

Still a further object of a preferred embodiment of the present invention is to provide a removable liquid manifold that is substantially rigid with minimal flexible hosing associated therewith to expedite removal and replacement.

Yet still another object of a preferred embodiment of the present invention is to provide a removable liquid transport assembly configured to permit removal of a reservoir, reservoir dip tube, pump head, non-return valve, pressure relief valve, riser tube, pinch tube and dispenser nozzle upon removal of a liquid manifold, i.e., the step of removing the liquid manifold simultaneously effectuates the removal of all of the other aforementioned components of the removable liquid transport assembly.

Still yet a further object of a preferred embodiment of the present invention is to provide a removable liquid transport assembly with a liquid storage container dip tube that can be readily separated from the other components of the removable liquid transport assembly to facilitate removal thereof.

Another object of a preferred embodiment of the present invention is to provide a Bottom-Loading water dispenser that employs a self-priming pump with a pump head and drive motor where the pump head can be readily disconnected and securely connected to the drive motor to permit the removal and replacement of the pump head.

A further object of a preferred embodiment of the present invention is to provide a Bottom-Loading water dispenser that allows water in a reservoir to flow back into a liquid storage container in the event that an operating condition occurs which causes the volume of liquid to rise beyond a predetermined maximum value (e.g., a portion of the liquid in the chilled reservoir should freeze) to prevent damage to one or more components of the water dispenser while preventing liquid in the reservoir from flowing back into the liquid storage container when the volume of liquid does not exceed the predetermined maximum value.

Still a further object of a preferred embodiment of the present invention is to provide a Bottom-Loading water dispenser with a non-return valve that is designed to minimize the pressure drop across the non-return valve to reduce the size of the pump and ensure that the non-return valve has little to no effect on the flow of liquid from the liquid storage container to the reservoir.

Yet still a further object of a preferred embodiment of the present invention is to provide a Bottom-Loading water dispenser that allows water in a reservoir to flow back into a liquid storage container without passing through the pump or pump head in the event that an operating condition occurs which causes the volume of liquid to rise beyond a predetermined maximum value (e.g., a portion of the liquid in the chilled reservoir should freeze) to prevent damage to one or more components of the water dispenser while preventing liquid in the reservoir from flowing back into the liquid storage container when the volume of liquid does not exceed the predetermined maximum value.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to an apparatus dispensing a liquid from a liquid storage container operably associated with the apparatus for dispensing a liquid. The apparatus includes a main housing having a dispensing location at which liquid from a liquid storage container is dispensed and a storage location for storing the liquid storage container. The dispensing location is disposed above at least a portion of the storage location. A reservoir is disposed in the housing. The reservoir is configured to receive a liquid from the liquid storage container prior to the liquid being dispensed from the main housing. A removable manifold is operably connected to the reservoir and the liquid storage container for conveying liquid between the reservoir and the liquid storage container. The removable manifold is further operably connected to the dispensing location to convey a liquid from the reservoir towards the dispensing location. The removable manifold has an upper chamber and a lower chamber. The upper chamber and the lower chamber share a common wall portion. The upper chamber is configured to direct a liquid from the reservoir towards the dispensing location in a substantially horizontal path. The lower chamber is configured to convey liquid between the liquid storage container and the reservoir in a substantially horizontal path. The upper chamber is disposed above the lower chamber.

Another preferred embodiment of the present invention is directed to an apparatus for dispensing a liquid from a liquid storage container operably associated with the apparatus for dispensing a liquid. The apparatus includes a main housing having a dispensing location at which liquid from a liquid storage container is dispensed and a storage location for storing a liquid storage container. The dispensing location is disposed above at least a portion of the storage location. A reservoir is disposed in the housing. The reservoir is configured to receive a liquid from the liquid storage container prior to the liquid being dispensed from the main housing. A valve assembly is disposed in a liquid flow path between the liquid storage container and the reservoir. The valve assembly includes a non-return valve and a pressure relief valve. The valve assembly further includes a valve housing for housing the non-return valve and the pressure relief valve. The valve assembly is configured such that when a volume of liquid upstream of the valve assembly exceeds maximum capacity, liquid upstream of the valve assembly can return to the liquid storage container. The valve assembly further is configured such that the non-return valve prevents liquid from flowing from the reservoir to the liquid storage container provided that the maximum capacity has not been exceeded.

A further preferred embodiment of the present invention is directed to an apparatus for dispensing a liquid from a liquid storage container operably associated with the apparatus for dispensing a liquid. The apparatus includes a main housing having a dispensing location at which liquid from a liquid storage container is dispensed and a storage location for storing a liquid storage container. The dispensing location is disposed above at least a portion of the storage location. A reservoir is disposed in the housing. The reservoir is configured to receive a liquid from the storage container prior to the liquid being dispensed from the main housing. A valve assembly is disposed in a liquid flow path between the liquid storage container and the reservoir. The valve assembly includes a non-return valve for preventing liquid from the reservoir to flow back into the liquid storage container. The non-return valve includes means for minimizing pressure drop across the non-return valve to minimize the effect the non-return valve has on liquid flow from the liquid storage container to the reservoir.

Still another preferred embodiment of the present invention is directed to an apparatus for dispensing a liquid from a liquid storage container operably associated with the apparatus for dispensing a liquid. The apparatus includes a main housing having a dispensing location at which liquid from a liquid storage container is dispensed and a storage location for storing a liquid storage container. The dispensing location is disposed above at least a portion of the storage location. A reservoir is disposed in the housing. The reservoir is configured to receive a liquid from the liquid storage container prior to the liquid being dispensed from the main housing. A self-priming pump has a pump head detachably connected to a drive motor. The self-priming pump is configured to pump liquid from the liquid storage container to the reservoir. The pump head is disposed in a removable manifold to allow the pump head to be readily replaced. The pump includes a drive pin and a drive crank. At least one of the drive crank and the drive pin includes means for facilitating mating of the pump head and the drive motor.

Still a further preferred embodiment of the present invention is directed to an apparatus for dispensing a liquid from a liquid storage container operably associated with the apparatus for dispensing a liquid. The apparatus includes a main housing having a dispensing location at which liquid from a liquid storage container is dispensed and a storage location for storing a liquid storage container. The dispensing location is disposed above at least a portion of the liquid storage location. The apparatus further includes a removable liquid transport assembly including a substantially rigid liquid manifold, a valve assembly, a reservoir and a pump head. The removable liquid transport assembly being configured such that the substantially rigid liquid manifold, the valve assembly, the reservoir and the pump head are removable from the main housing as a single unit. The substantially rigid liquid manifold having a liquid flow channel through which liquid traveling between the liquid storage container and the reservoir passes. At least a portion of the pump head is disposed in the liquid flow channel of the substantially rigid manifold. At least a portion of the valve assembly is disposed in the liquid flow channel of the substantially rigid liquid manifold. The liquid flow channel is configured to connect the valve assembly to the pump head without using any flexible tubing. The reservoir is connected to the liquid flow channel of the substantially rigid manifold. The valve assembly includes at least one of a pressure relief valve and a non-return valve.

Another preferred embodiment of the present invention is directed to a liquid transport assembly for a liquid dispenser to convey a liquid between a liquid storage container and a dispensing location of the liquid dispenser. The liquid transport assembly includes a removable liquid transport assembly configured to be readily installed in and removed from a liquid dispenser to permit the liquid dispenser to be readily sanitized. The removable liquid transport assembly includes a substantially rigid liquid manifold, a valve assembly, a reservoir and a pump head. The removable liquid transport assembly is configured such that the substantially rigid liquid manifold, the valve assembly, the reservoir and the pump head are removable from the liquid dispenser as a single unit. The substantially rigid liquid manifold has a liquid flow channel through which liquid travel passes during operation of the liquid dispenser. At least a portion of the pump head is disposed in the liquid flow channel of the substantially rigid manifold. At least a portion of the valve assembly is disposed in the liquid flow channel of the substantially rigid liquid manifold. The liquid flow channel is configured to connect the valve assembly to the pump head without using any flexible tubing. The reservoir is connected to the liquid flow channel of the substantially rigid manifold. The valve assembly includes at least one of a pressure relief valve and a non-return valve.

A further preferred embodiment of the present invention is directed to a liquid transport assembly for a liquid dispenser to convey a liquid between a liquid storage container and a dispensing location of the liquid dispenser. The liquid transport assembly includes a removable liquid transport assembly configured to be readily installed in and removed from a liquid dispenser to permit the liquid dispenser to be readily sanitized. The removable liquid transport assembly includes a liquid manifold, a valve assembly, a reservoir and a pump head. The removable liquid transport assembly is configured such that the liquid manifold, the valve assembly, the reservoir and the pump head are removable from the liquid dispenser as a single unit. The valve assembly includes at least a pressure relief valve.

DETAILED DESCRIPTION OF THE PREFERRED EMBODIMENT OF THE INVENTION

The preferred forms of the invention will now be described with reference to FIGS. 1-19. The appended claims are not limited to the preferred form and no term and/or phrase used herein is to be given a meaning other than its ordinary meaning unless it is expressly stated otherwise.

FIGS. 1 THROUGH 13

Figure 1:
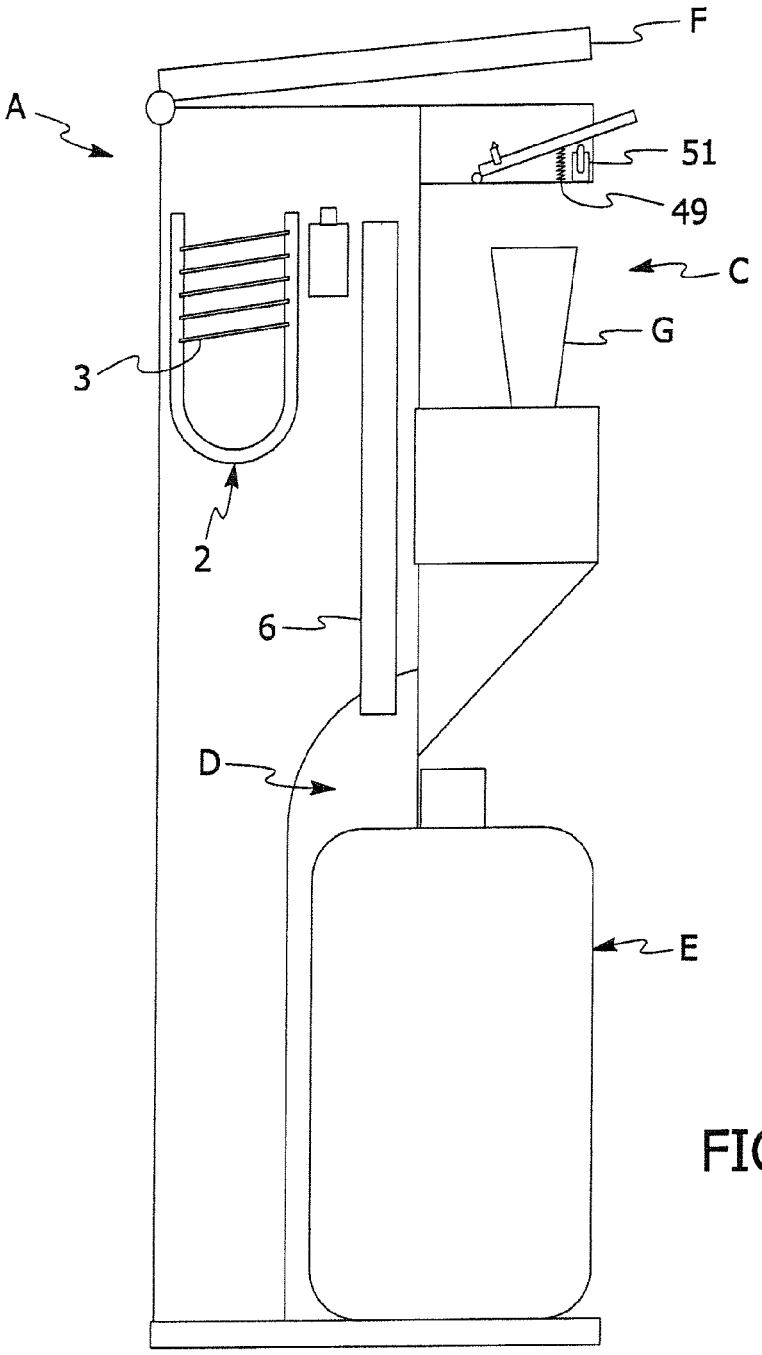
FIG. 1 is a cross-sectional view of a water dispenser formed in accordance with a preferred embodiment of the present invention with the liquid transport assembly removed therefrom.
Figure 2:
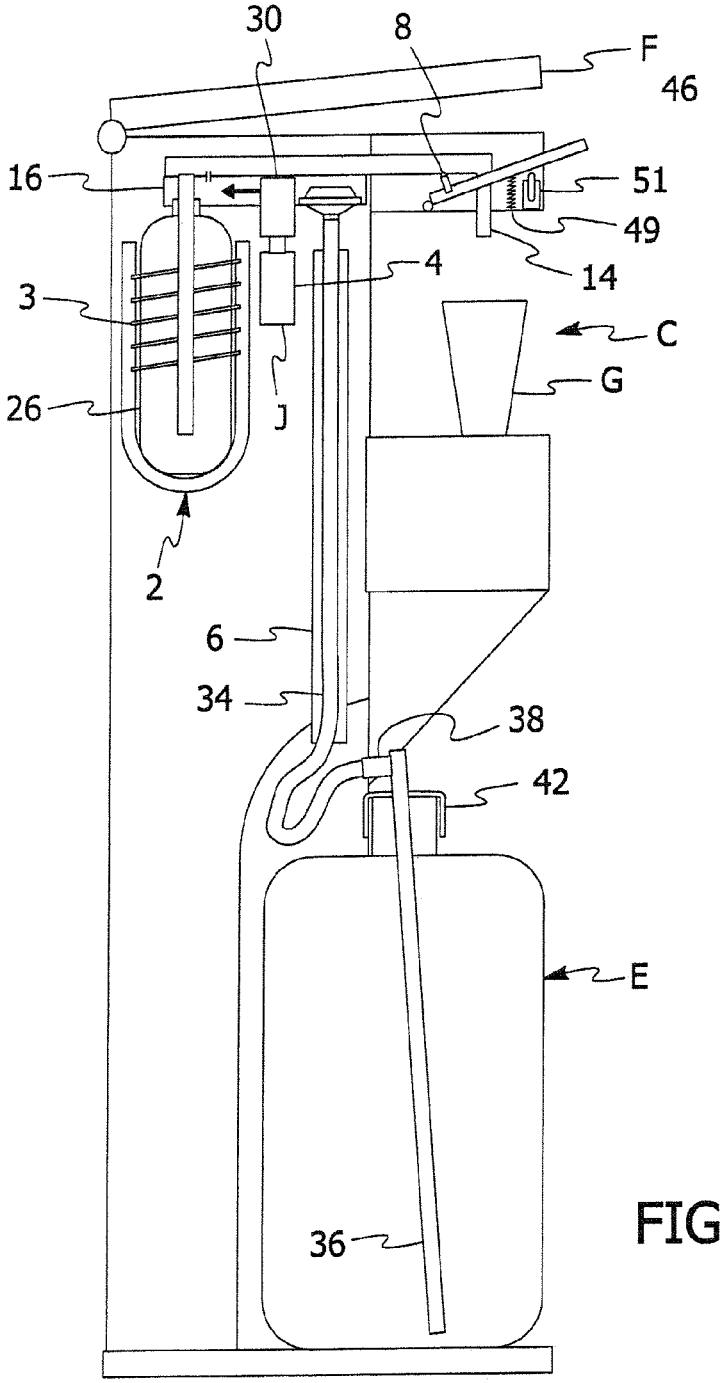
FIG. 2 is a view similar to that depicted in FIG. 1 with the liquid transport assembly formed in accordance with a preferred embodiment of the present invention installed in the water dispenser.

Referring to FIGS. 1 to 13, a liquid dispenser A employing a preferred form of the invention is illustrated in one of many possible configurations. In the most preferred form, liquid dispenser A dispenses chilled and hot water for human consumption. However, the present invention is not limited to a liquid dispenser that dispenses chilled and hot water for human consumption. Rather, the liquid dispenser may dispense other liquids including but not limited to ambient temperature drinking water and carbonated liquids. Liquid dispenser A includes a main housing B having a substantially hollow internal cavity for housing components of the liquid dispenser, a liquid dispensing location C and a liquid storage location D for receiving and storing a liquid storage container E in an upright orientation. Liquid dispenser A further includes a cover F pivotally connected to main housing B. Any suitable latch mechanism may be used to permit the forward edge of the cover F to be secured to and released from a corresponding front edge of main housing B. Referring to FIGS. 1 and 2, a cup G is shown in the liquid dispensing location C. The liquid storage container E is preferably a conventional five (5) gallon water bottle oriented in an upright manner.

Referring to FIGS. 1 and 2, a reservoir housing 2, a cooling system 3, a pump motor 4 and a riser tube guide member 6 are disposed in the internal cavity of liquid dispenser A. Liquid dispenser A includes a removable liquid transport assembly H as seen, for example, in FIGS. 2 and 6 through 9. The removable liquid transport assembly H includes a substantially rigid conduit housing 8 removably connected to a substantially rigid liquid manifold 10 as seen for example in FIGS. 4 and 5. Conduit housing 8 and manifold 10 may be formed out of any suitable material including plastic. Any suitable fasteners may be used to removably secure conduit housing 8 to liquid manifold 10. Further, it will be readily appreciated that conduit housing 8 may be permanently fixed to liquid manifold 10 or may be formed as one piece with liquid manifold 10.

Figure 8:
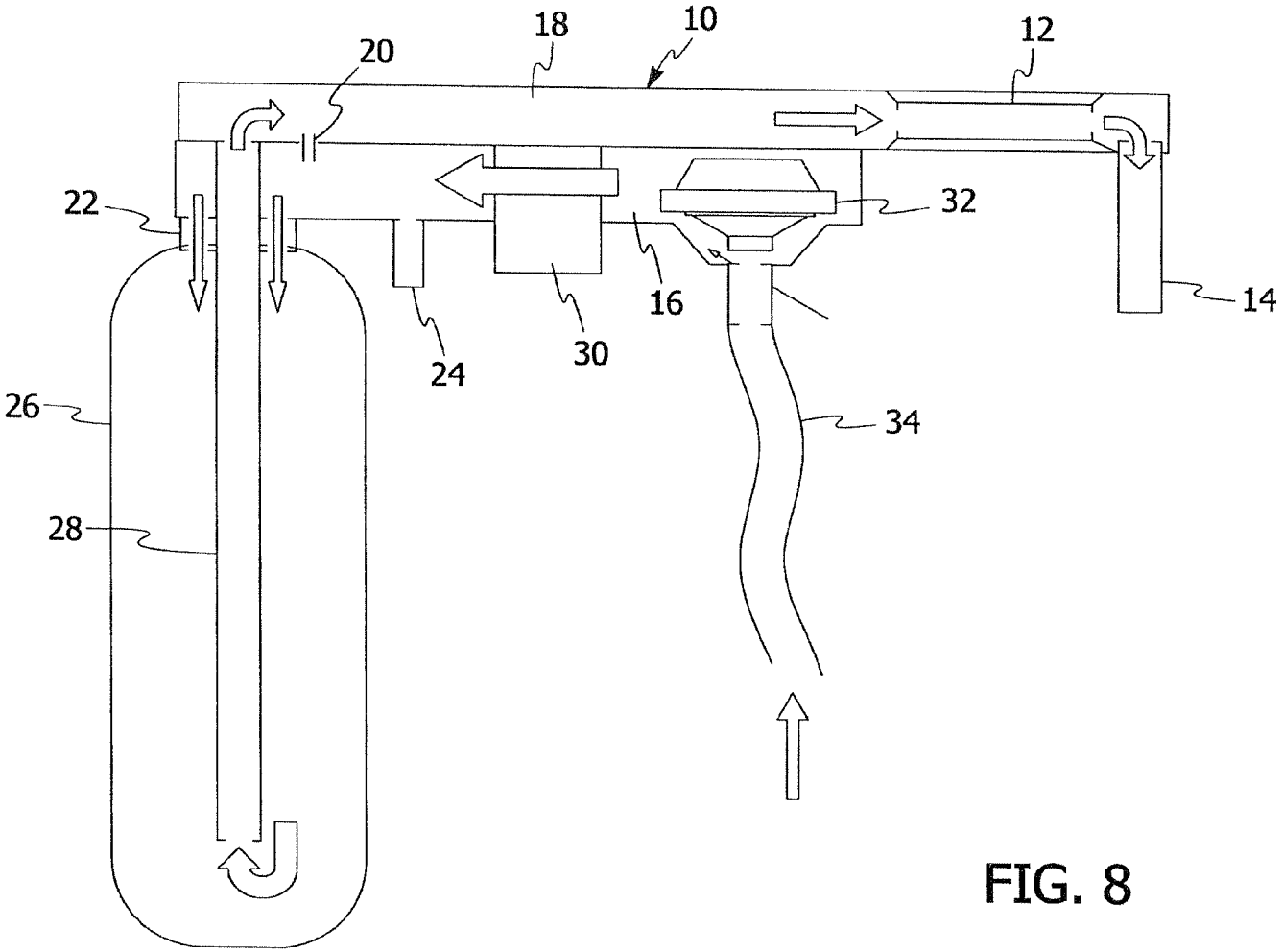
FIG. 8 is a fragmentary cross-sectional view of a liquid transport assembly formed in accordance with a preferred embodiment of the present invention.
Figure 9:
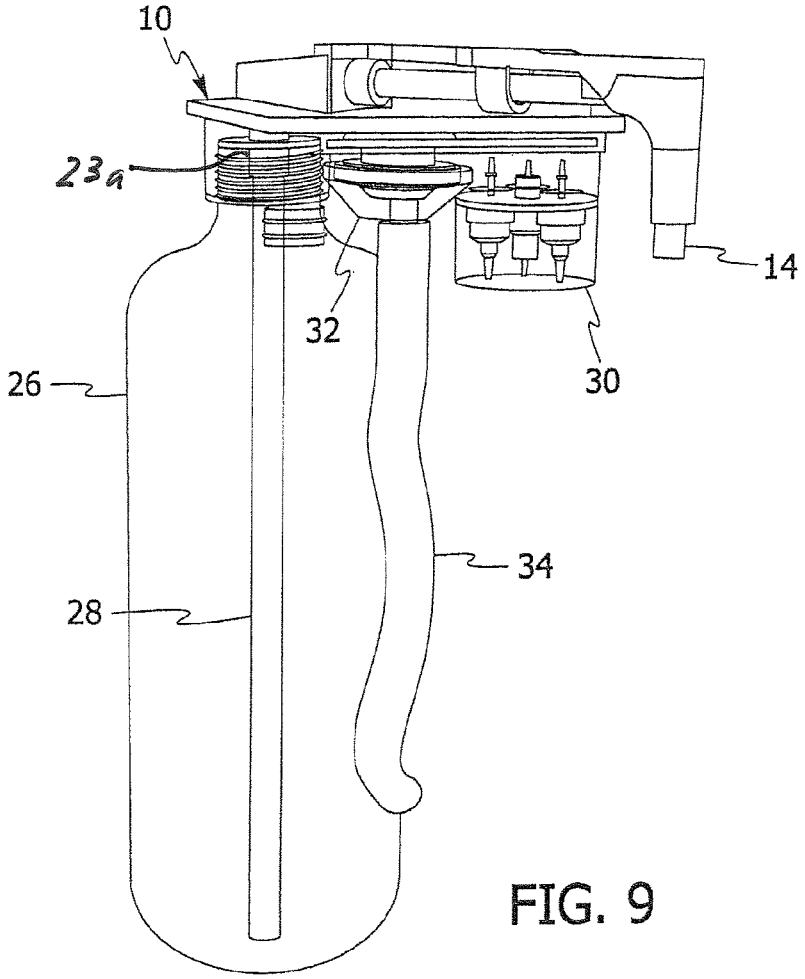
FIG. 9 is a fragmentary perspective view of a liquid transport assembly formed in accordance with a preferred embodiment of the present invention with various aspects shown in phantom to permit viewing of other components.
Figure 9A:
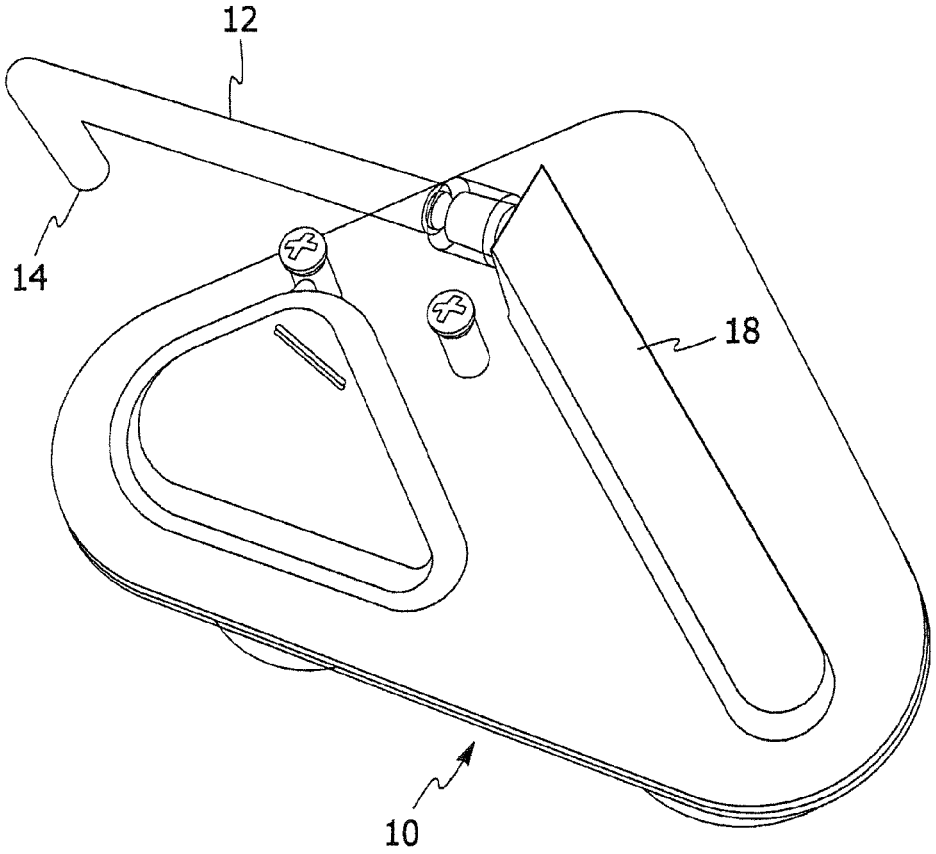
FIG. 9A is a perspective view of a portion of the liquid transport assembly formed in accordance with a preferred embodiment of the present invention.
Figure 9B:
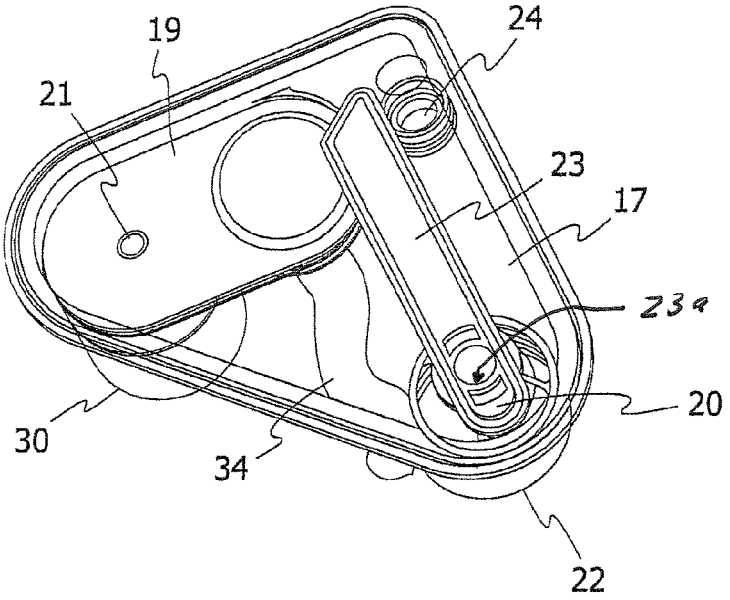
FIG. 9B is a perspective view similar to FIG. 9A with portions removed to permit viewing of the internal cavity of a liquid manifold formed in accordance with a preferred embodiment of the present invention.
Figure 9C:
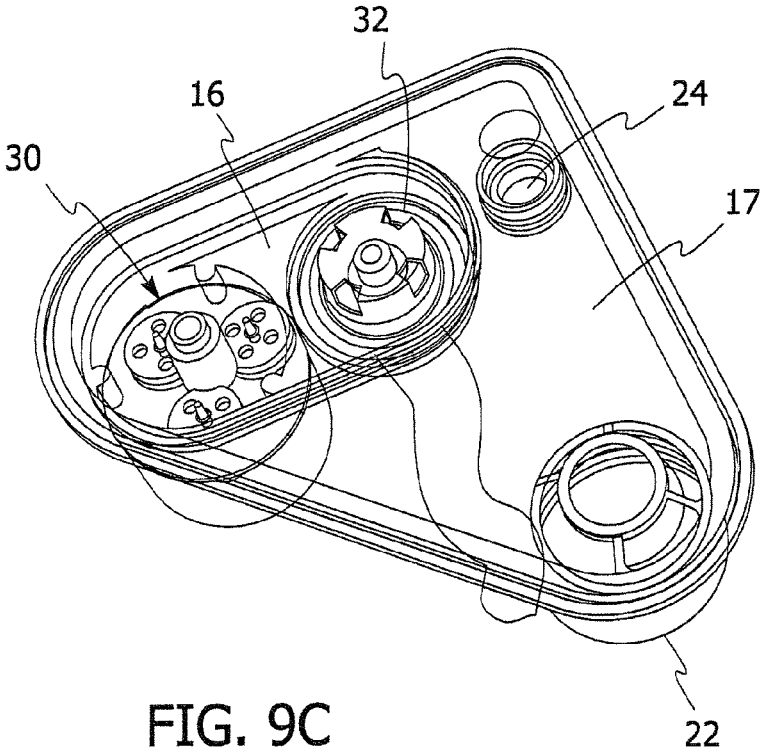
FIG. 9C is a perspective view similar to FIG. 9B with the cover plate for one of the lower chambers removed to permit viewing of the internal cavity of the particular lower chamber.

Conduit housing 8 preferably houses a pinch tube 12 and a dispensing nozzle 14. In the most preferred form, as seen in FIG. 9A, the pinch tube 12 and the dispensing nozzle 14 are formed from a single piece of silicon rubber. However, the pinch tube 12 and the dispensing nozzle 14 could be formed from separate pieces that are connected in a fluid tight manner. Referring to FIGS. 8, 9B and 9C, liquid manifold 10 includes lower chambers 16 and 17, an upper chamber 18 and a small vent hole 20. Liquid manifold 10 further includes an internally threaded collar 22 and a secondary dispensing port 24. Referring to FIGS. 9B and 9C, lower chamber 16 is smaller than lower chamber 17. A cover plate 19 separates lower chamber 16 and lower chamber 17. Opening 21 formed in cover plate 19 allows liquid to pass from lower chamber 16 to lower chamber 17. Referring to FIGS. 9A and 9B, lower chamber 17 and upper chamber 18 share wall portion 23. Referring to FIGS. 9 and 9B, for example, wall portion 23 includes a lower section/segment 23*a* that extends downwardly into reservoir 26. Further, wall portion 23 forms the lowermost portion of upper chamber 18.

Figure 7:
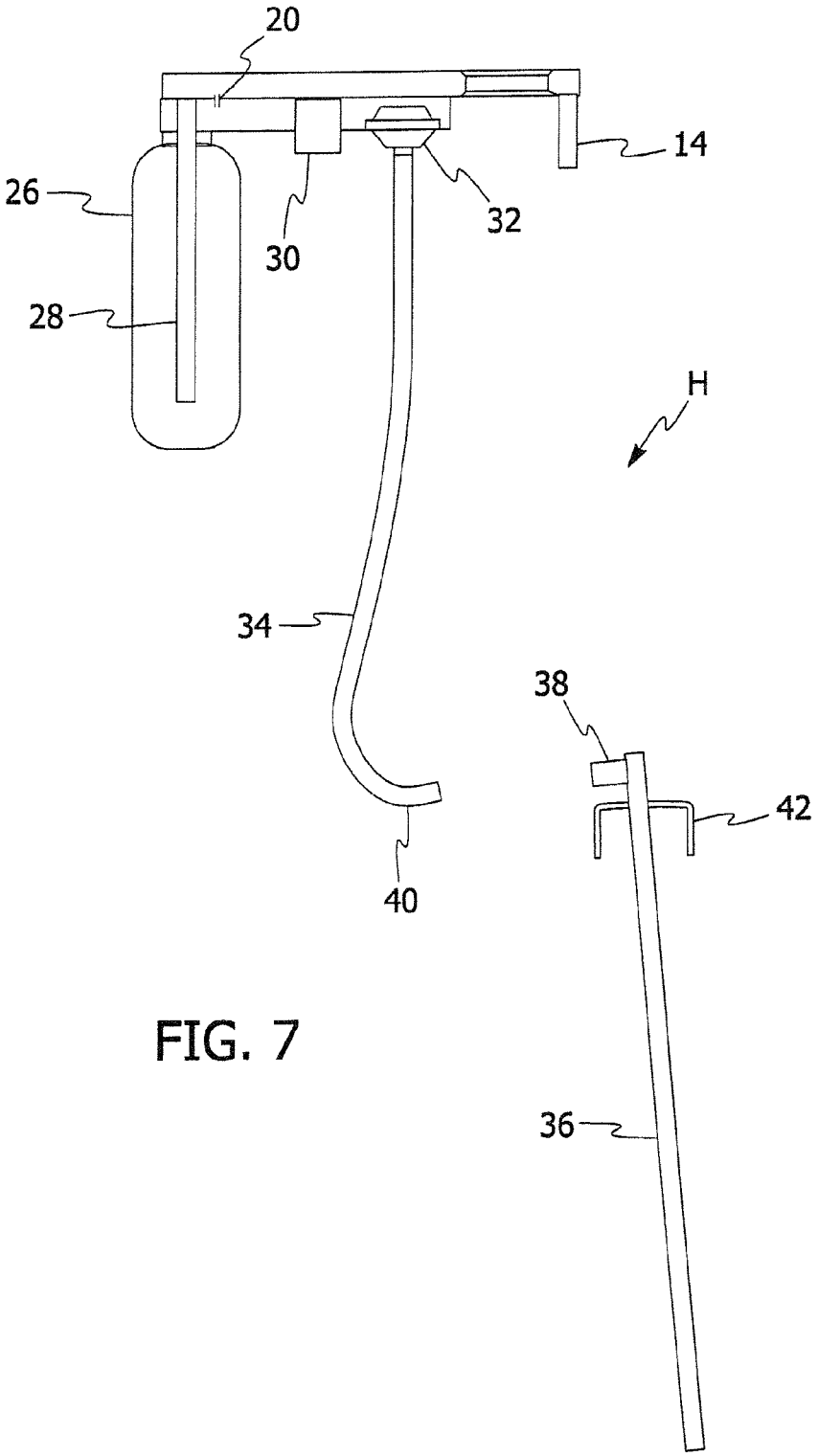
FIG. 7 is a cross-sectional view of a liquid transport assembly formed in accordance with a preferred embodiment of the present invention.

The removable liquid transport assembly H further includes a reservoir 26 having a neck portion with external threads corresponding to the internal threads of collar 22 so that the reservoir 26 can be readily connected to liquid manifold 10. It will be readily appreciated that reservoir 26 may be connected to liquid manifold 10 in numerous other ways. The removable liquid transport assembly H further includes a reservoir dip tube 28, a pump head 30, a valve assembly 32, a riser tube 34 and a liquid storage container dip tube 36 having a connecting member 38 for removably connecting the liquid storage container dip tube 36 to the lower end 40 of riser tube 34. As clearly seen in FIG. 9, lower section/segment 23*a* of wall portion 23 receives an upper end of reservoir dip tube 28. As shown in FIG. 7, the liquid storage container dip tube 36 extends into liquid storage container E through cap 42 of container E.

The secondary dispensing port 24 may be connected to a hot water supply assembly I including a hot water reservoir (not shown), a hot water reservoir dip tube (not shown), a heating element (not shown), one or more conduits (not shown) for conveying hot water from the hot water reservoir to a second dispensing nozzle (not shown). The hot water supply assembly I can be omitted. Where the hot water supply assembly I is omitted, the secondary dispensing port 24 may be plugged to prevent the flow of water through port 24. Alternatively, the secondary dispensing port 24 may be operably connected to a second dispensing nozzle in a well-known manner to dispense water at ambient temperature through the second dispensing nozzle when lever 44 is depressed. Alternatively, the secondary dispensing port 24 can be connected to a carbonated liquid source to dispense a carbonated liquid from the second dispensing nozzle.

Figure 4:
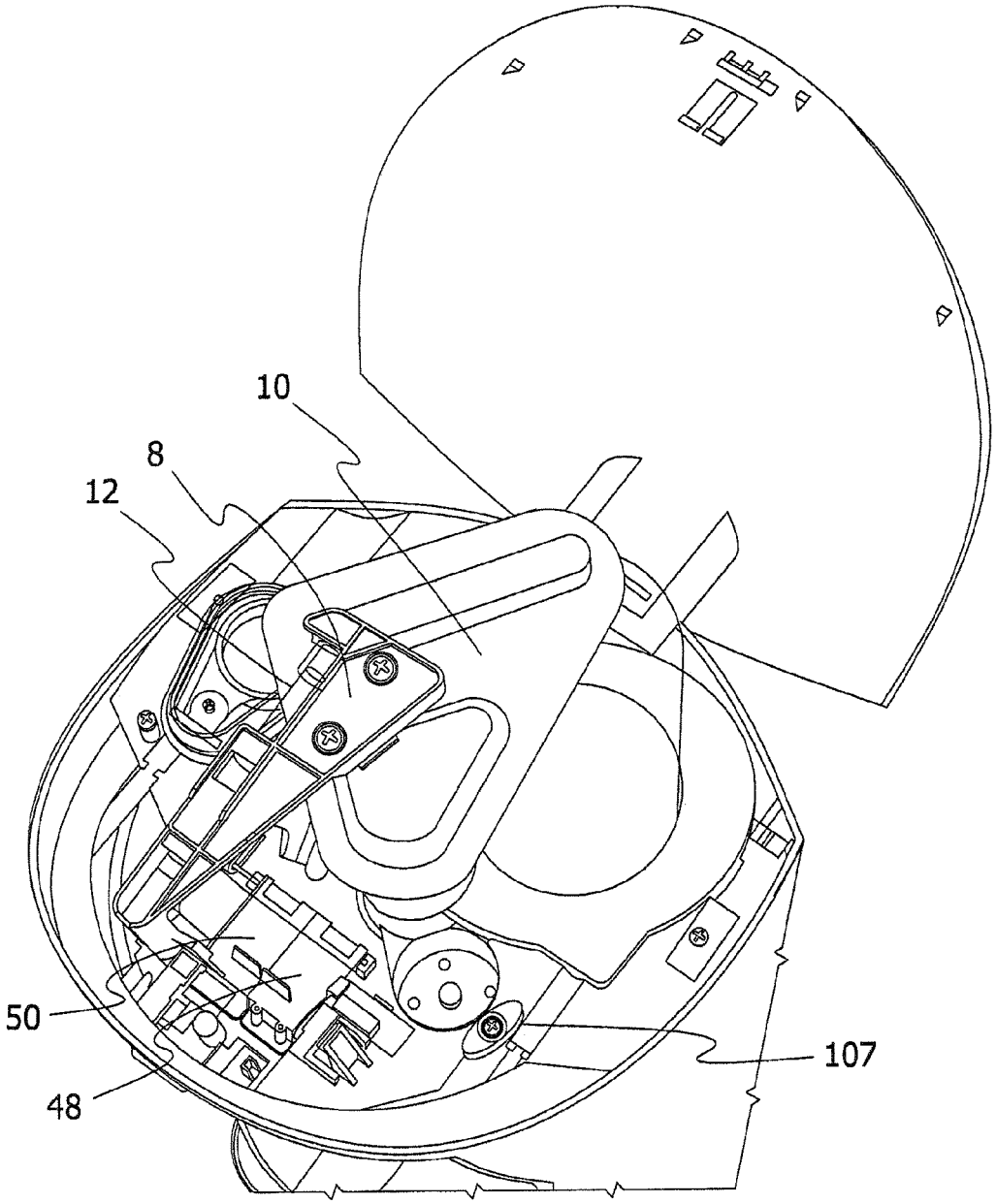
FIG. 4 is fragmentary perspective view of a water dispenser formed in accordance with a preferred embodiment of the present invention.

Cold water tap lever 46 controls the flow of chilled water from reservoir 26 through dispensing nozzle 14. Referring to FIG. 4, a pinch valve 48 is operably associated with cold water tap lever 46 to control the flow of chilled water out dispensing nozzle 14. Specifically, pinch valve 48 acts on pinch tube 12 in a well-known manner to prevent the flow of chilled water out dispensing nozzle 14 until such time as lever 46 is depressed. Spring 49 biases lever 46 upwardly causing pinch valve 48 to close off pinch tube 12. Once the biasing force of spring 49 is overcome by a person depressing lever 46, a micro switch 51 activates self-priming pump J to pump water from container E upwardly through dip tube 36 and riser tube 34 into lower chamber 16 of liquid manifold 10. The liquid travels through valve assembly 32 and pump head 30 and passes into lower chamber 17 through opening 21. Liquid flowing through chamber 17 empties into reservoir 26 (which chills the water stored therein)

which in turn causes chilled water stored in reservoir 26 to pass upwardly through dip tube 28 into upper chamber 18 and out dispensing nozzle 14. The flow of liquid when lever 46 is depressed is shown by the arrows in FIG. 8.

Pinch valve 50 is operably associated with lever 44 to act in a similar manner to permit and prevent liquid to flow out a second dispensing nozzle (not shown). In the most preferred form, the liquid dispensed from the second dispensing nozzle is hot water. When lever 44 is depressed, pump J pumps liquid from container E through dip tube 36 and riser tube 34 into lower chamber 16 of liquid manifold 10 and out secondary dispensing port 24 into a hot water reservoir which in turn causes the hot water stored in the water heating reservoir to flow through a dip tube into one or more conduits connecting the hot water reservoir to the second dispensing nozzle (not shown) and ultimately out the second dispensing nozzle (not shown).

Figure 10:
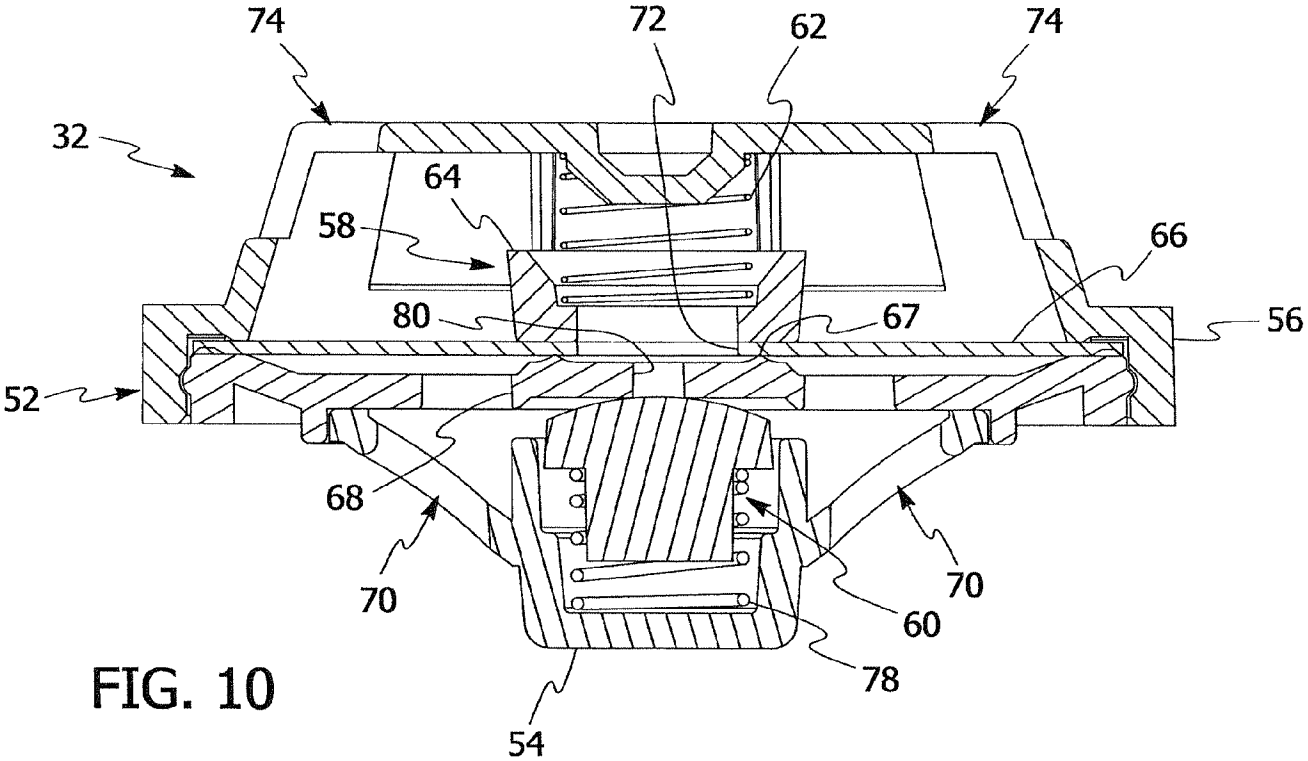
FIG. 10 is cross-sectional view of a preferred form of valve assembly.

Referring to FIGS. 8 and 10, the valve assembly 32 will be described in greater detail. Valve assembly 32 includes a valve housing 52 having a lower valve housing member 54 and an upper valve housing member 56. Preferably, a non-return valve 58 and a pressure relief valve 60 are disposed in housing 52. Non-return valve 58 includes a spring 62, a spring follower 64, a diaphragm 66 and a sealing ring 68. In the closed position, diaphragm 66 seats on annular seat 67 of sealing ring 68 as illustrated in FIG. 10. When lever 46 is depressed, pump J sucks liquid upwardly causing the liquid to pass through dip tube 36, through the riser tube 34 and through openings 70 in lower valve housing member 54. When the force of the liquid is sufficient to overcome the force of spring 62, diaphragm 66 moves upwardly off the annular seat 67 of sealing ring 68 which in turn causes the liquid to pass through flow hole 72 formed in diaphragm 66 out openings 74 in upper valve housing member 56. The liquid in turn passes through pump head 30 and enters reservoir 26 forcing chilled water stored in reservoir 26 to ultimately pass out through dispensing nozzle 46 as previously described. When lever 46 is released, the pump deactivates ceasing the flow of liquid from container E which allows spring 62 to reseat diaphragm 66 on annular seat 67 of sealing ring 68 as shown in FIG. 10. When the sealing valve assembly 52 is in the position illustrated in FIG. 10, liquid in reservoir 26 cannot flow back into container E.

The non-return valve 58 is designed to minimize the pressure drop across the non-return valve to prevent the non-return valve from adversely affecting the flow of liquid from container E to reservoir 26. By designing the valve 58 to have minimal effect on the flow of liquid, the preferred embodiment can minimize the size of the pump. The pressure drop is minimized by the fact that to open the valve 58 flow in the forward direction must pull against the full area of the diaphragm 66 while to close the valve 58 spring 62 need only overcome the annular seat 67 of sealing ring 68. As is readily evident from FIG. 10, the outer diameter of the diaphragm 66 is significantly greater than the diameter of the annular seat 67 of sealing ring 68. In a most preferred form, the outer diameter of the diaphragm 66 is approximately 32 mm while the diameter of the annular seat 67 of the sealing ring 68 is approximately 8 mm. This relationship provides an advantageous pressure ratio of 16:1.

Vent hole 20 allows air to escape through dispensing nozzle 46. When the supply of liquid in container E is exhausted, a small amount of air will be pumped through the liquid transport assembly and vented through vent hole 20 effectively stopping the liquid dispenser A from dispensing liquid until the exhausted container E is replaced.

The pressure relief valve 60 includes a sealing element 76, a spring 78 and vent hole 80 formed in sealing ring 68. Should the volume of the liquid upstream of valve assembly 52 increase beyond a predetermined maximum volume, the upstream liquid will exert a downward force on sealing element 76 which in turn opens vent hole 80 allowing upstream liquid to return to container E. Once a sufficient amount of upstream liquid has returned to container E, the force of spring 78 will return sealing element 76 to the closed position preventing any additional upstream liquid from flowing back into container E. It should be noted that when liquid flows upwardly from container E in route to reservoir 26 the liquid does not pass through pressure relief valve 60 as the sealing element 76 is in the position shown in FIG. 10 to close off the vent hole 80. One condition that could cause pressure relief valve 60 to open is where a portion of the liquid in reservoir 26 freezes causing an increase in the effective volume of the liquid upstream of valve assembly 52. Without pressure relief valve 60, one or more components of the liquid dispenser A could be irreparably damaged.

As seen in FIGS. 8, 9B and 9C, valve assembly 52 extends into lower chamber 16 of liquid manifold 10 and is secured thereto such that the valve assembly moves with liquid manifold 10.

Figure 11:
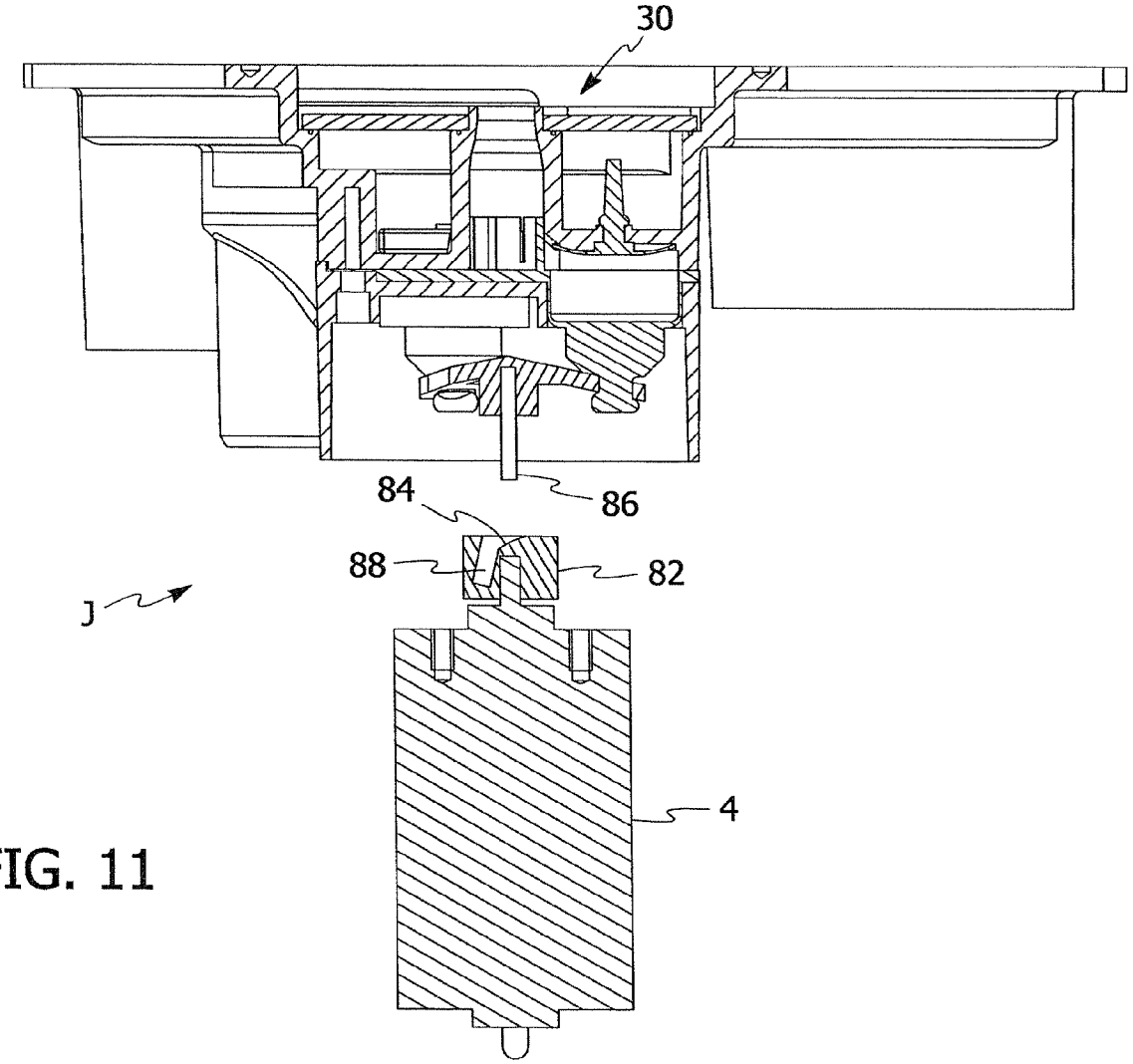
FIG. 11 is a cross-sectional view of a preferred form of self-priming pump for a preferred embodiment of the present invention with the drive motor shown detached from the pump head.
Figure 12:
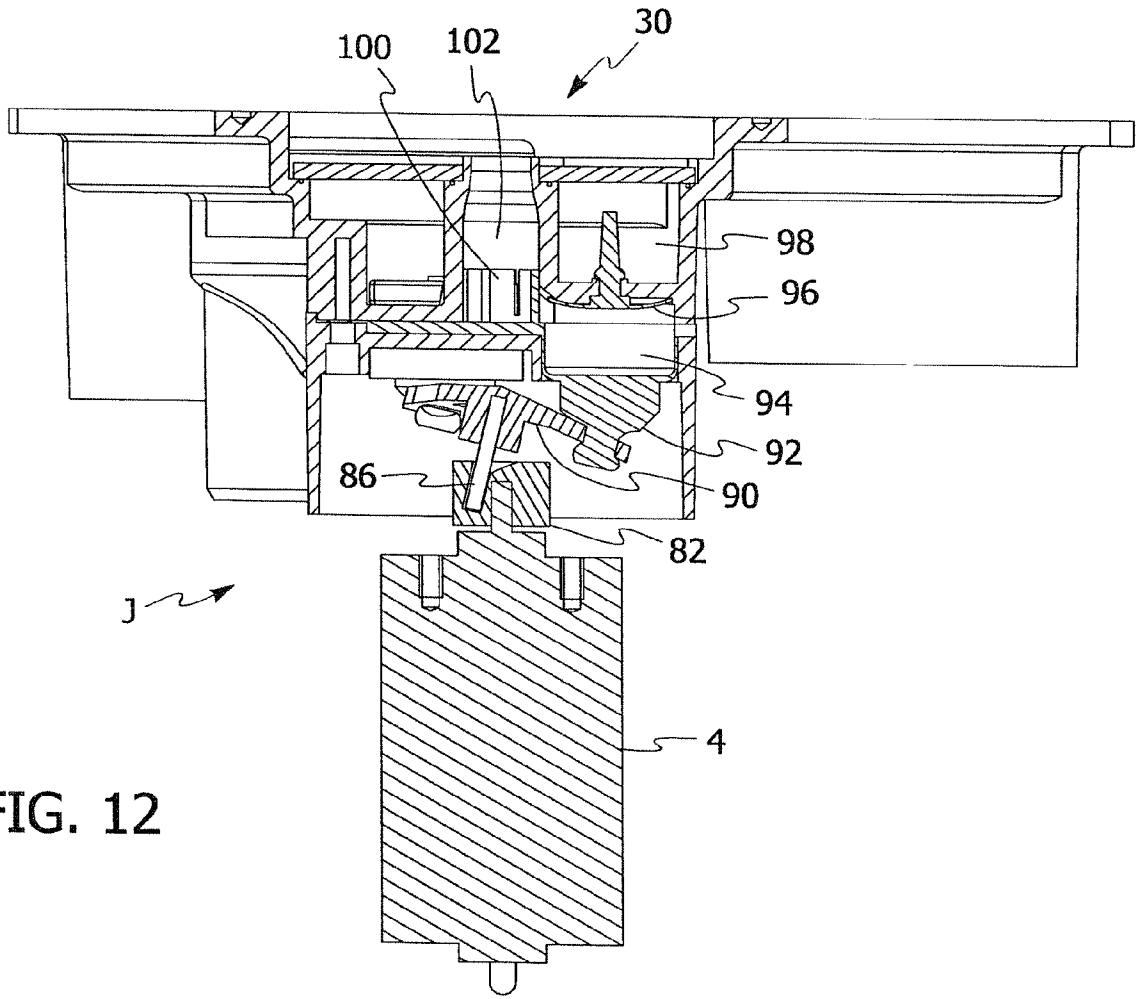
FIG. 12 is a cross-sectional view of a preferred form of self-priming pump for a preferred embodiment of the present invention with the drive motor shown connected to the pump head.
Figure 13:
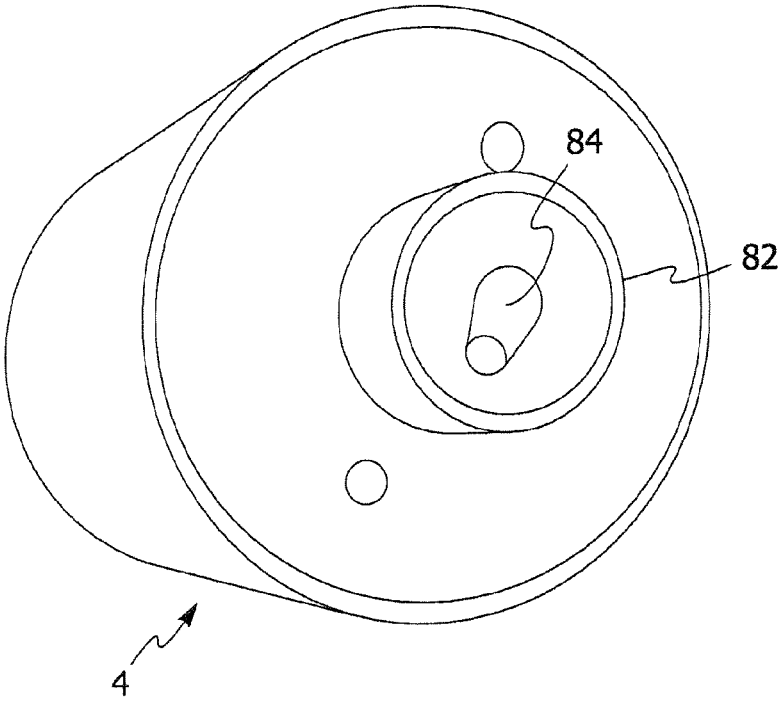
FIG. 13 is a perspective view of a preferred form of drive motor.

The self-priming pump J will now be described in greater detail with reference being made to FIGS. 11 to 13. In the most preferred form, self-priming pump J is a three cylinder swash-plate diaphragm pump having a drive motor 4 and a pump head 30. The pump head 30 can be readily disconnected from the drive motor 4 by merely moving the pump head 30 upwardly from the engaged position shown in FIG. 12 to the disengaged position shown in FIG. 11. Drive motor 4 includes a drive crank 82 that rotates upon activation of drive motor 4 by micro switch 51. The drive crank 82 preferably includes a sloping surface 84 that drive pin 86 of pump head 30 strikes when the pump head 30 is connected to the drive motor 4. The sloping surface 84 facilitates the mating of drive motor 4 and pump head 30 by guiding the drive pin 86 into the angled socket 88 thereby orienting swash plate 90 at the desired angle. Swash plate 90 is connected to piston 92 that moves in cylinder 94 formed in pump head 30. Pump head 30 further includes an inlet valve 96, an inlet chamber 98, an outlet valve 100 and an outlet chamber 102. As is readily seen in FIG. 8, pump head 30 extends into lower chamber 16 of liquid manifold 10 and secured thereto such that the pump head 30 moves with liquid manifold 10.

Figure 3:
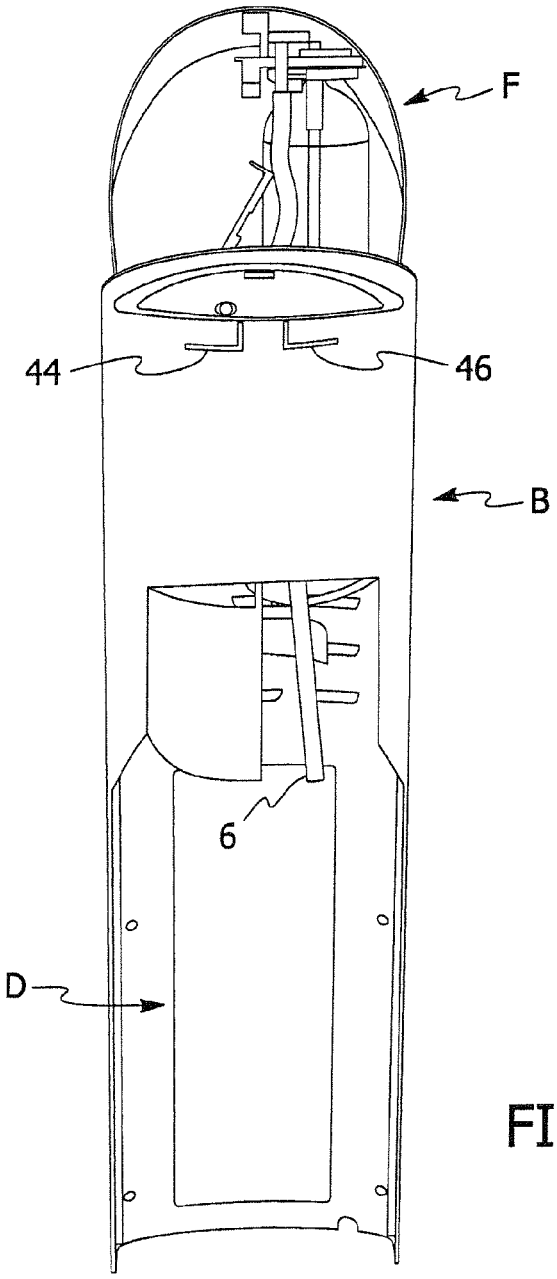
FIG. 3 is a front elevation view of a water dispenser formed in accordance with a preferred embodiment of the present invention with the water bottle and portions of the main housing removed.
Figure 5:
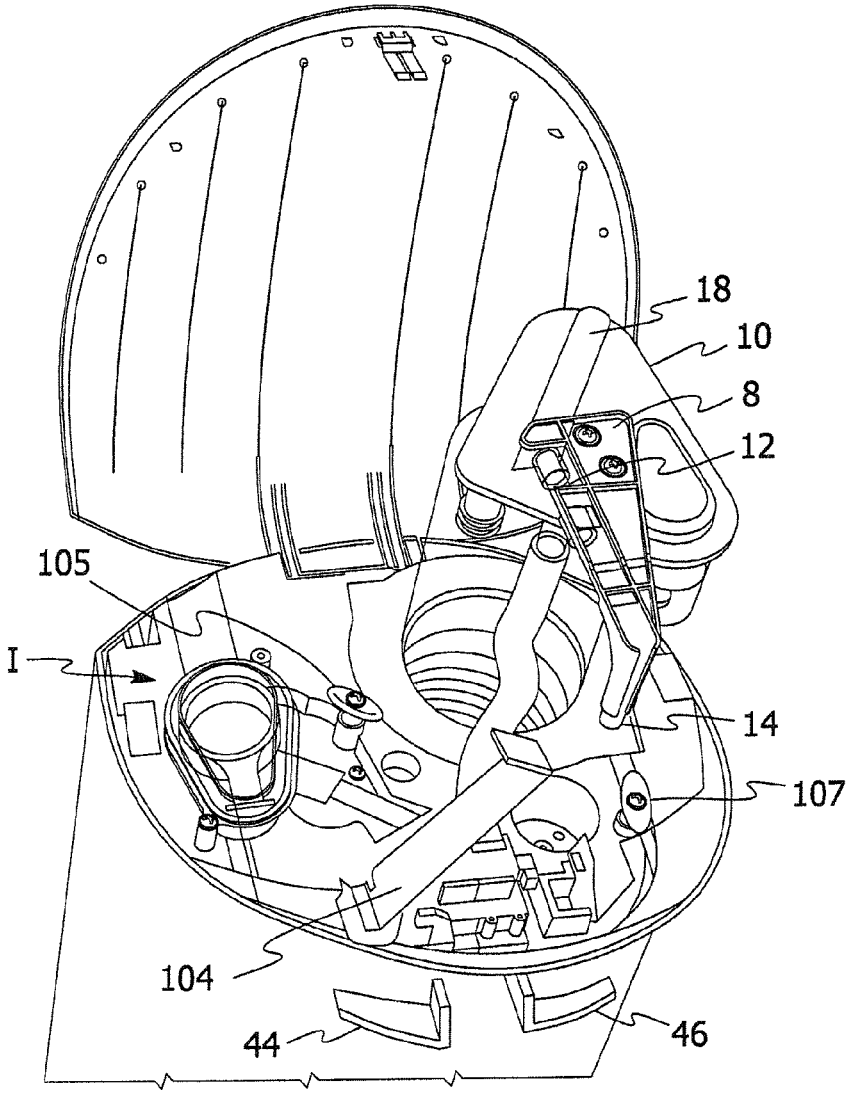
FIG. 5 is a fragmentary perspective view similar to that depicted in FIG. 4 but from a slightly different vantage point to reveal components not readily seen in FIG. 4.
Figure 6:
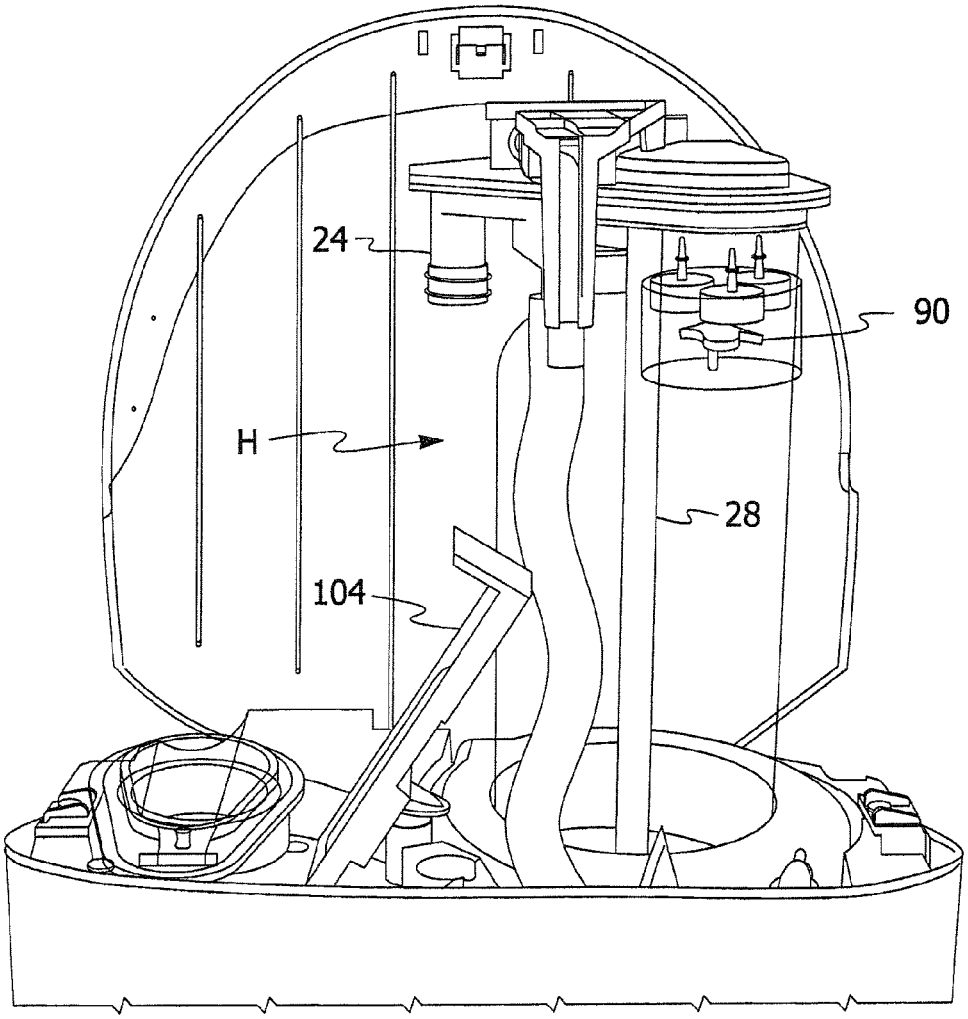
FIG. 6 is a fragmentary perspective view of a water dispenser formed in accordance with a preferred embodiment of the present invention with various aspects shown in phantom to permit viewing of other components.

To readily replace the bulk of the liquid transport assembly H, one need only raise lid F, raise latch 104 to the position shown in FIGS. 3, 5 and 6 to free conduit housing 8, turn rotating clamps 105 and 107 to the positions shown in FIG. 5 to free manifold 10, disconnect riser tube 34 from dip tube 36 and raise liquid manifold 10 upwardly which in turn causes all of the elements of the liquid transport assembly shown in FIGS. 8 and 9 connected to liquid manifold 10 to move upwardly with liquid manifold 10. Hence, the portions of the liquid transport assembly H illustrated in FIGS. 8 and 9 can be readily removed and replaced as a unit. Once removed the portion of the liquid transport assembly H shown in FIGS. 8 and 9 can be replaced with a new, sanitized assembly having the same components as the removed portion of the liquid transport assembly H. Guide member 6 having a hollow cavity generally conforming to the shape of riser tube 34 and having slightly larger dimensions facilitates insertion of the sanitized riser tube 34. Once separated from riser tube 34, dip tube 36 can easily and readily be removed and replaced with a sanitized dip tube.

FIGS. 14 THROUGH 19

Referring to FIGS. 14 through 19, an alternate form of removable liquid transport assembly K will now be described that can be used with liquid dispenser A in place of liquid transport assembly H. Removable liquid transport assembly K is similar to removable liquid transport assembly H and, therefore, only the differences will be described in detail. The use of the same reference numerals to describe components of assemblies H and K indicates the assemblies have the same component. The removable liquid transport assembly K includes a substantially rigid conduit housing 8 removably connected to a substantially rigid liquid manifold 10 as seen for example in FIG. 14. Conduit housing 8 and manifold 10 may be formed out of any suitable material including plastic. Any suitable fasteners may be used to removably secure conduit housing 8 to liquid manifold 10. Further, it will be readily appreciated that conduit housing 8 may be permanently fixed to liquid manifold 10 or may be formed as one piece with liquid manifold 10.

Figure 14:
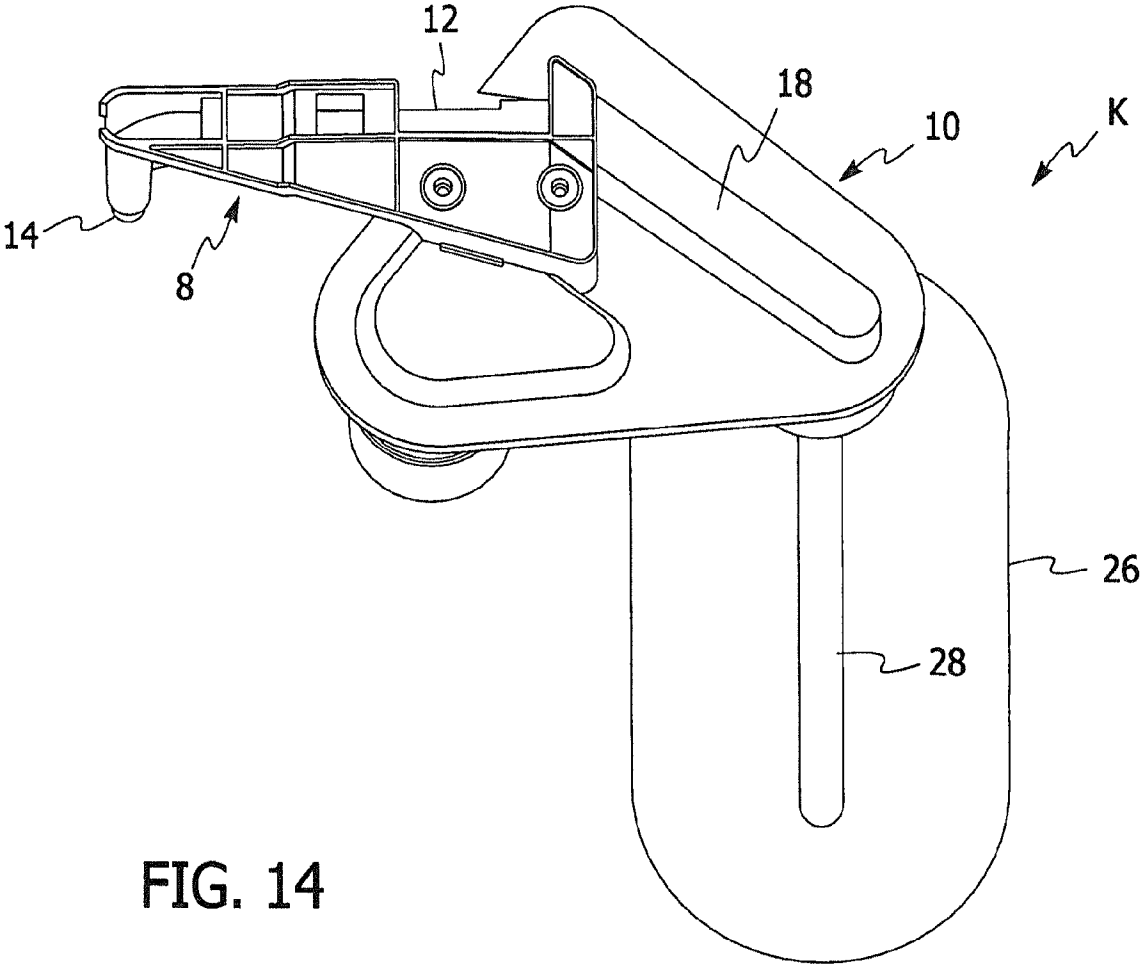
FIG. 14 is a perspective view of a portion of a liquid transport assembly formed in accordance with an alternative embodiment of the present invention with the reservoir shown in phantom to permit viewing of the reservoir dip tube.
Figure 15:
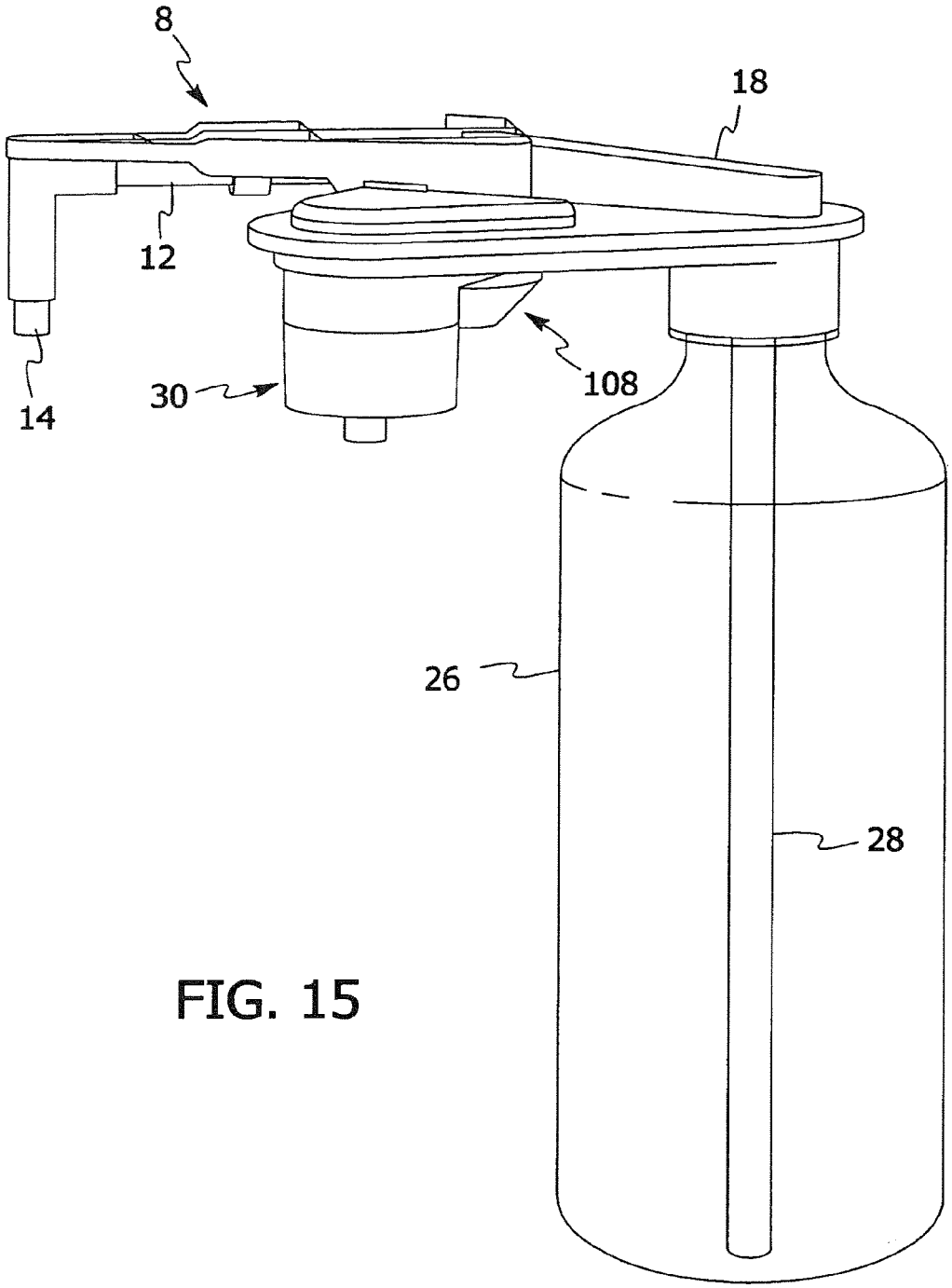
FIG. 15 is a perspective view of the portion of a liquid transport assembly illustrated in FIG. 14 taken from a different angle.
Figure 17:
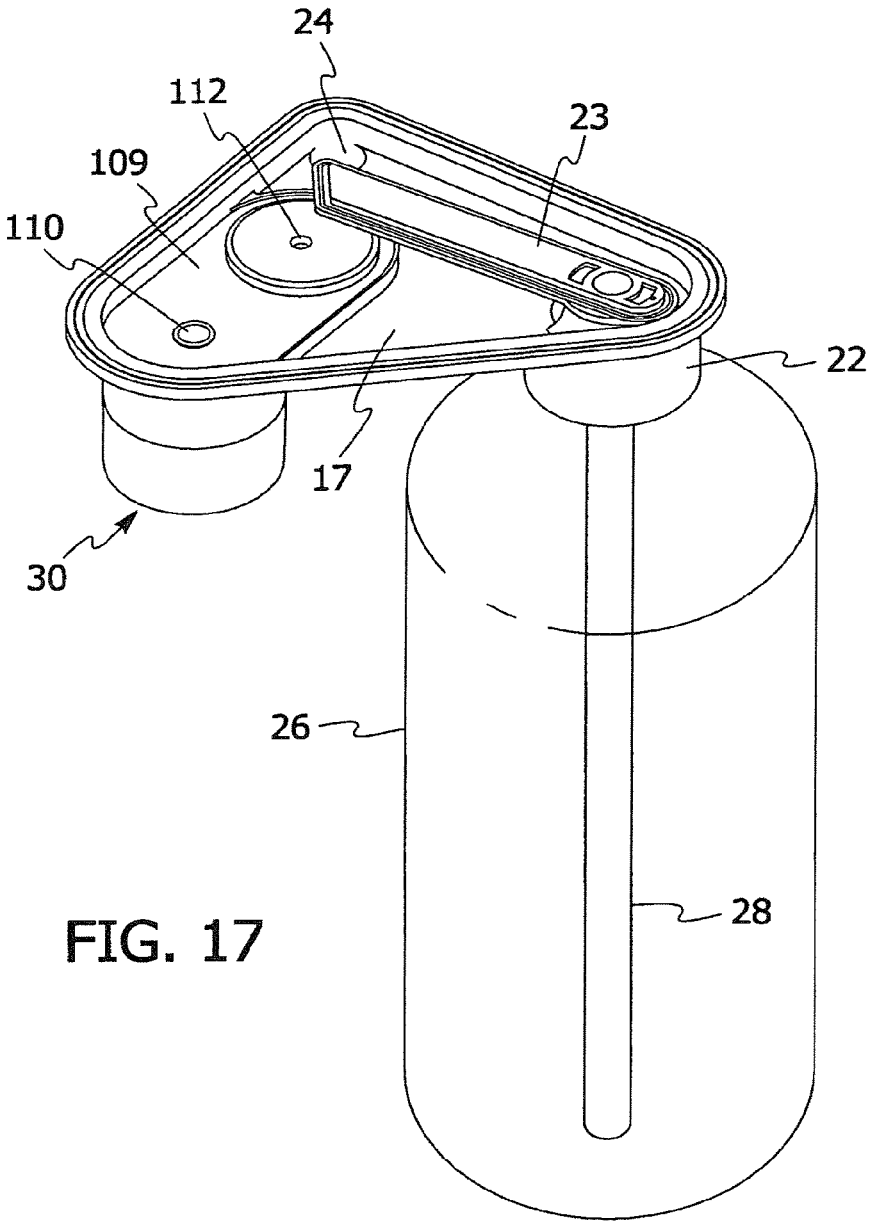
FIG. 17 is a perspective view similar to FIG. 14 with portions removed to permit viewing of the internal cavity of a liquid manifold.
Figure 18:
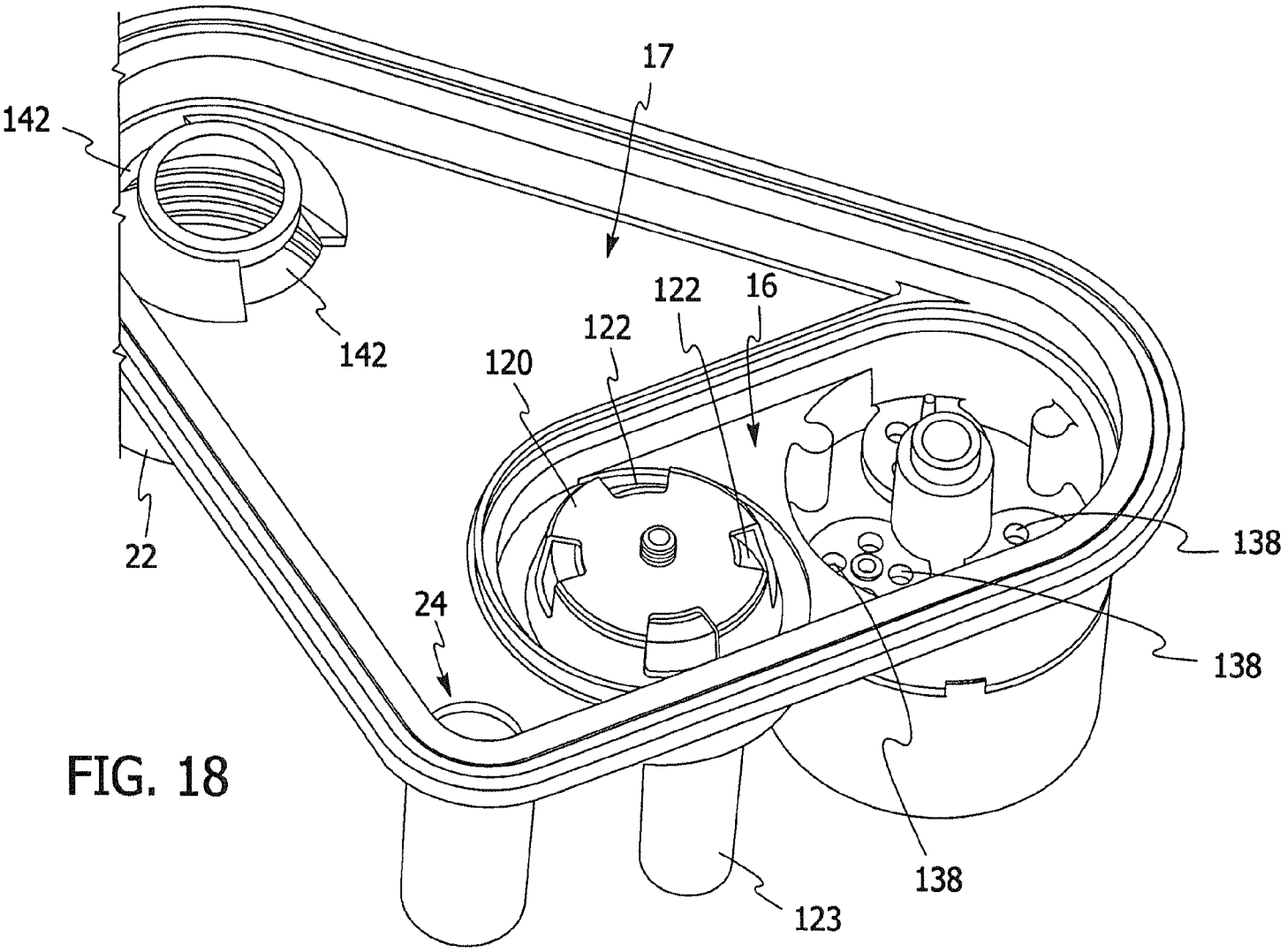
FIG. 18 is an enlarged perspective view similar to FIG. 17 with portions removed to permit viewing of the internal cavity of a liquid manifold.

Conduit housing 8 preferably houses a pinch tube 12 and a dispensing nozzle 14. In the most preferred form, as seen in FIG. 14, the pinch tube 12 and the dispensing nozzle 14 are formed from a single piece of silicon rubber. However, the pinch tube 12 and the dispensing nozzle 14 could be formed from separate pieces that are connected in a fluid tight manner. Referring to FIGS. 14 and 18, liquid manifold 10 includes lower chambers 16 and 17 and an upper chamber 18. Liquid manifold 10 further includes an internally threaded collar 22 and a secondary dispensing port 24. Referring to FIG. 18, lower chamber 16 is smaller than lower chamber 17. As seen in FIG. 18, a cover plate 109 separates lower chamber 16 and lower chamber 17. Openings 110 and 112 formed in cover plate 109 allow liquid to pass from lower chamber 16 to lower chamber 17. Referring to FIG. 17, lower chamber 17 and upper chamber 18 share a wall portion 23 which forms the lowermost portion of upper chamber 18.

The removable liquid transport assembly K further includes a reservoir 26 having a neck portion with external threads corresponding to the internal threads of collar 22 so that the reservoir 26 can be readily connected to liquid manifold 10. It will be readily appreciated that reservoir 26 may be connected to liquid manifold 10 in numerous other ways. The removable liquid transport assembly K further includes a reservoir dip tube 28, a pump head 30 and a valve assembly 108. A riser tube and a liquid storage container dip tube having a connecting member as described in connection with liquid transport assembly H may be used to connect the valve assembly 108 to a liquid storage container similar to liquid storage container E.

The secondary dispensing port 24 may be connected to a hot water supply assembly including a hot water reservoir, a hot water reservoir dip tube, a heating element, one or more conduits for conveying hot water from a hot water reservoir to a second dispensing nozzle. The hot water supply assembly can be omitted. Where the hot water supply assembly is omitted, the secondary dispensing port 24 may be plugged to prevent the flow of water through port 24. Alternatively, the secondary dispensing port 24 may be operably connected to a second dispensing nozzle in a well-known manner to dispense water at ambient temperature through the second dispensing nozzle. Alternatively, the secondary dispensing port 24 can be connected to a carbonated liquid source to dispense a carbonated liquid from the second dispensing nozzle.

The flow of cold water from reservoir 26 through dispensing nozzle 14 can be controlled with the components described in connection with liquid transport assembly H.

Figure 16:
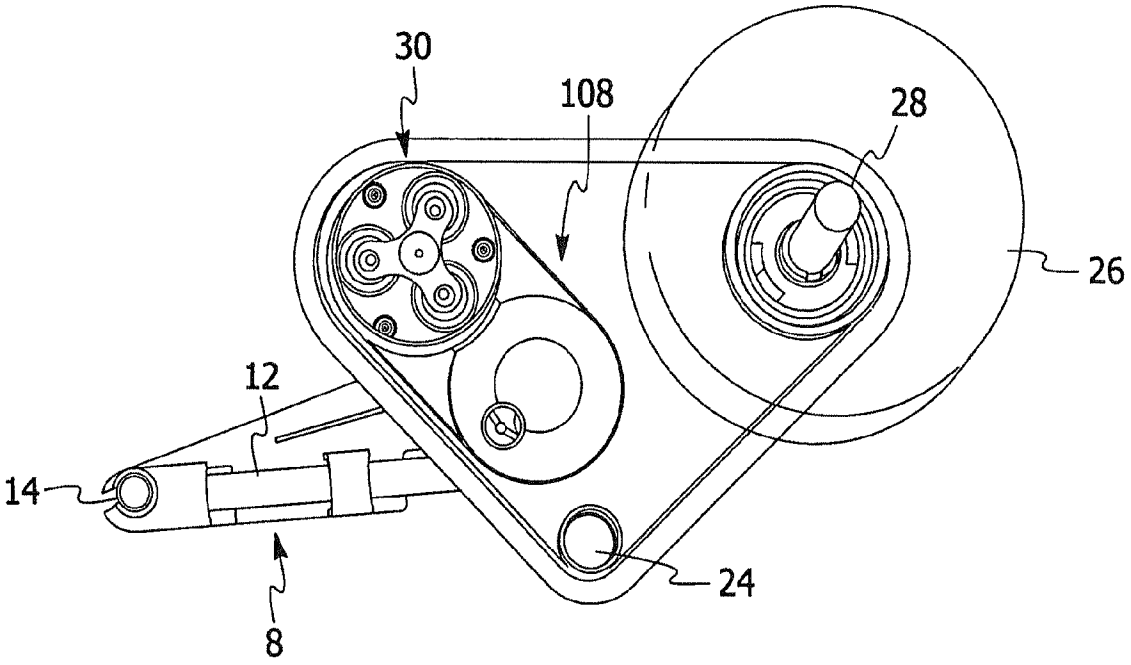
FIG. 16 is a perspective view of the portion of a liquid transport assembly illustrated in FIG. 14 as seen from the bottom.
Figure 19:
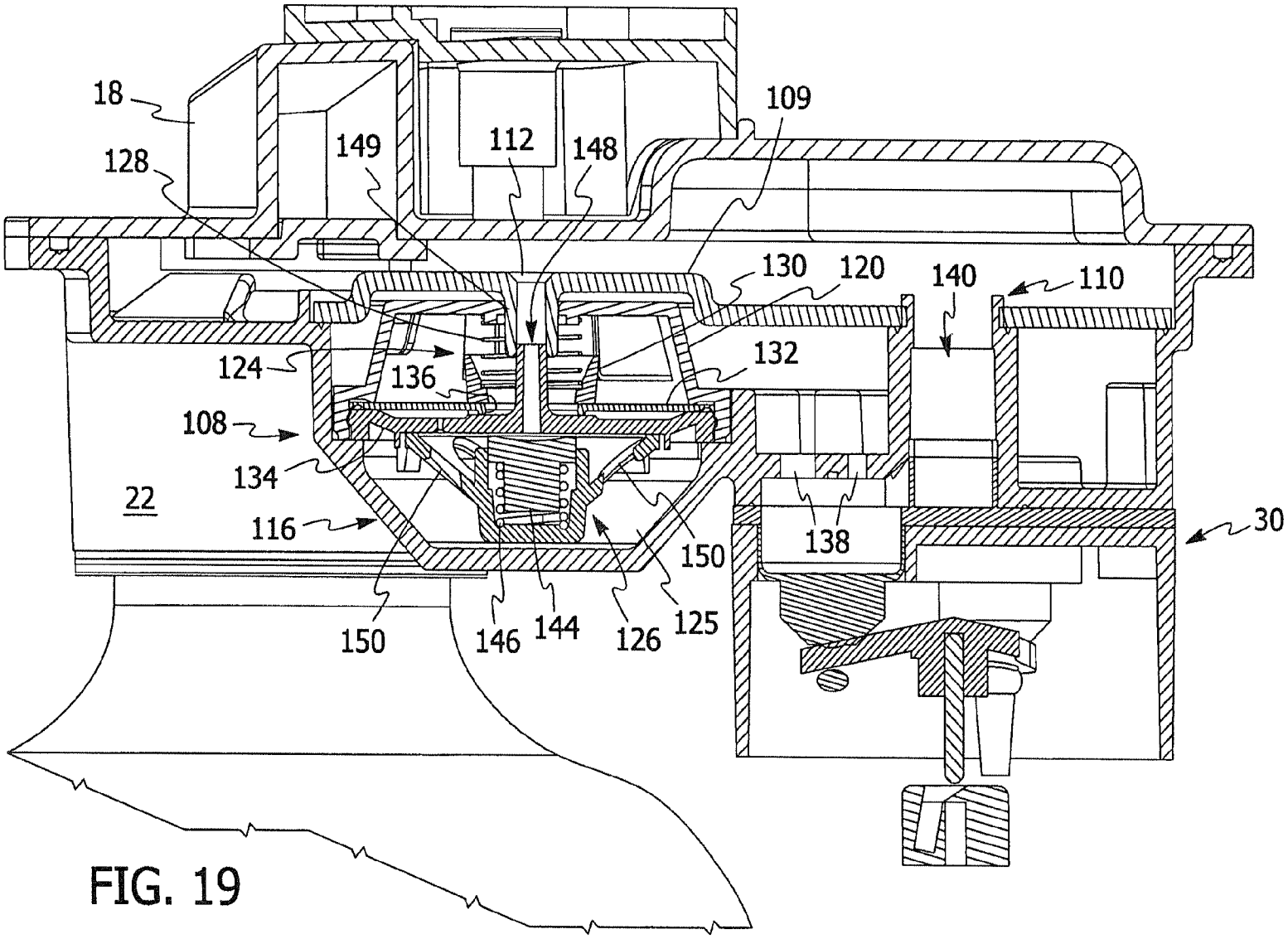
FIG. 19 is a fragmentary cross-sectional view of the liquid transport assembly illustrated in FIG. 14.

Referring to FIGS. 18 and 19, the valve assembly 108 will be described in greater detail. Valve assembly 108 includes valve housing having a lower valve housing member 116 and an upper valve housing member 120. A plurality of openings 122 are formed in upper valve housing 120 as shown in FIG. 18. Referring to FIGS. 16 and 18, a conduit 123 connects the riser tube (not shown) to the chamber 125 formed by lower valve housing member 116 so that liquid from the liquid storage container may pass from the riser tube into chamber 125. Preferably, a non-return valve 124 and a pressure relief valve 126 are disposed in the valve housing. Non-return valve 124 includes a spring 128, a spring follower 130, a diaphragm 132 and a sealing ring 134. In the closed position, diaphragm 132 seats on sealing ring 134 as illustrated in FIG. 19. When a lever like lever 46 is depressed, a pump similar to pump J sucks liquid upwardly causing the liquid to pass through the dip tube, through the riser tube and through conduit 123 into chamber 125. When the force of the liquid is sufficient to overcome the force of spring 128, diaphragm 132 moves upwardly off the sealing ring 134 which in turn causes the liquid to pass through flow hole 136 formed in diaphragm 132 out openings 122 in upper valve housing member 120. The liquid in turn passes through a plurality of openings 138 into pump head 30. Openings 138 communicate with passageway 140 allowing liquid to pass through passageway 140 of pump head 30 and out opening 110. The liquid then enters reservoir 26 through openings 142 forcing chilled water stored in reservoir 26 to ultimately pass upwardly through reservoir tube 28, through chamber 18, through tube 12 and through nozzle 14. When the lever is released, the pump deactivates ceasing the flow of liquid from the container which allows spring 128 to reseat diaphragm 132 on sealing ring 134 as shown in FIG. 19. When the sealing valve assembly 108 is in the position illustrated in FIG. 19, liquid in reservoir 26 cannot flow back through pump head 30 into chamber 125.

The non-return valve 124 is designed similar to non-return valve 58 to minimize the pressure drop across the non-return valve to prevent the non-return valve from adversely affecting the flow of liquid from the container to reservoir 26.

The pressure relief valve 126 includes a sealing element 144 and a spring 146. When in the position shown in FIG. 19, sealing element 144 seals the lower end of vertically extending passageway 148 formed in sealing ring 134. Should the volume of the liquid upstream of valve assembly 108 increase beyond a predetermined maximum volume, the upstream liquid will exert a downward force on sealing element 144 which in turn opens the lower end of passageway 148 allowing upstream liquid to pass downwardly though opening 112 formed in plate 109 into annular conduit 149 preferably formed as one piece with plate 109. The liquid then passes through passageway 148, through openings 150, through chamber 125 and through conduit 123 in route to the liquid storage container. Once a sufficient amount of upstream liquid has returned to the container, the force of spring 146 will return sealing element 144 to the closed position preventing any additional upstream liquid from flowing back into the container. It should be noted that when liquid flows upwardly from container E in route to reservoir 26 the liquid does not pass through pressure relief valve 126 as the sealing element 144 is in the position shown in FIG. 19 to close off passageway 148. Sealing ring 134 includes openings similar to the openings in sealing ring 68 shown in FIG. 10 to allow liquid to flow from lower chamber 125 through opening 136 formed in diaphragm 132. One condition that could cause pressure relief valve to open is where a portion of the liquid in reservoir 26 freezes causing an increase in the effective volume of the liquid upstream of valve assembly 108. Without the pressure relief valve, one or more components of the liquid dispenser could be irreparably damaged. As is readily appreciated from the above description, when one or more conditions exist which cause sealing element 144 to overcome the force of spring 146, upstream liquid flows back into the container through valve assembly 108 without passing through pump head 30. In fact, liquid cannot flow from pump head 30 to chamber 125.

As seen in FIG. 18, valve assembly 108 extends into lower chamber 16 of liquid manifold 10 and is secured thereto such that the valve assembly moves with liquid manifold 10.

A self-priming pump similar to self-priming pump J can be operably connected to pump head 30. The liquid transport assembly K can be readily replaced in a manner similar to liquid transport assembly H.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. An apparatus for a bottom-loading liquid dispenser to convey a liquid between a liquid storage container and a dispensing location of the bottom-loading liquid dispenser, said apparatus comprising:

(a) a removable manifold including a reservoir, a reservoir dip tube extending into said reservoir, an upper section and a lower section, said removable manifold further including a liquid dispensing conduit for dispensing a liquid from the bottom-loading liquid dispenser when said removable manifold is installed in an operating position in the bottom-loading liquid dispenser, an outlet of said upper section being connected to said liquid dispensing conduit and an inlet of said upper section being connected to said reservoir, said upper section being configured to convey a liquid in a first flow path from said reservoir into said liquid dispensing conduit, said lower section of said removable manifold including an inlet for receiving a liquid from a liquid storage container of a liquid dispenser stored below said removable manifold when said removable manifold is installed in an operating position in the bottom-loading liquid dispenser, said lower section further including an annular collar operably connected to an uppermost portion of said reservoir and, wherein said lower section having a liquid chamber surrounding said reservoir dip tube, said lower section being configured to convey said liquid from said liquid storage container through said annular collar around said reservoir dip tube to fill said reservoir in a second flow path.

2. The apparatus of claim 1, wherein:

(a) a throat of said reservoir extends into said annular collar.

3. The apparatus of claim 1, wherein:

(a) said liquid chamber surrounding said reservoir dip tube receives said liquid from said liquid storage container and directs said liquid into said reservoir around said dip tube.

4. The apparatus of claim 3, wherein:

(a) said annular collar surrounds at least a portion of said liquid chamber.

5. The apparatus of claim 1, wherein:

(a) said upper section is smaller than said lower section.

6. An apparatus for a bottom-loading liquid dispenser to convey a liquid between a liquid storage container and a dispensing location of the bottom-loading liquid dispenser, said apparatus comprising:

(a) a removable manifold including a reservoir, a reservoir dip tube extending into said reservoir, an upper section and a lower section, said removable manifold further including a liquid dispensing conduit for dispensing a liquid from the bottom-loading liquid dispenser when said removable manifold is installed in an operating position in the bottom-loading liquid dispenser, an outlet of said upper section being connected to said liquid dispensing conduit and an inlet of said upper section being connected to said reservoir, said upper section being configured to convey a liquid in a first flow path from said reservoir into said liquid dispensing conduit, said lower section of said removable manifold including an inlet for receiving a liquid from a liquid storage container of a liquid dispenser stored below said removable manifold when said removable manifold is installed in an operating position in the bottom-loading liquid dispenser, said lower section further including an annular portion configured to connect with an annular uppermost portion of said reservoir and, wherein said lower section having a liquid chamber surrounding said reservoir dip tube, said lower section being configured to convey said liquid from said liquid storage container through said liquid chamber of said lower section and around said reservoir dip tube to fill said reservoir in a second flow path.

7. The apparatus of claim 6, wherein:

(a) said upper section is smaller than said lower section.

8. The apparatus of claim 6, wherein:

(a) a throat of said reservoir extends into said annular portion of said lower section.

9. An apparatus for a bottom-loading water cooler to convey water between a water storage bottle and a dispensing location of the bottom-loading water cooler, said apparatus comprising:

(a) a removable manifold including a water reservoir, a reservoir dip tube extending into said water reservoir, a first section, a second section and a water dispensing conduit for dispensing water from the bottom-loading water cooler when said removable manifold is installed in an operating position in the bottom-loading water cooler, said first section being configured to direct water in said water reservoir to said water dispensing conduit, an outlet of said first section being connected to said water dispensing conduit and an inlet of said first section being configured to receive water from said water reservoir, said second section being configured to direct water received from a water storage bottle to said water reservoir, said second section including an inlet for receiving water from the water storage bottle of the bottom-loading water cooler stored below said removable manifold when said removable manifold is installed in an operating position in the bottom-loading water cooler wherein an uppermost portion of the water storage bottle is disposed below a lowermost portion of said first section and a lowermost portion of said second section when said water storage bottle is stored in an operating position in the bottom-loading water cooler, said second section further including an annular portion configured to connect with an annular uppermost portion of said water reservoir and, wherein said second section having a water chamber surrounding said reservoir dip tube, said second section being configured to convey water received from said water storage bottle through said water chamber of said second section and around said reservoir dip tube to fill said water reservoir.

10. The apparatus of claim 9, wherein:

(a) said first section is smaller than said second section.

11. The apparatus of claim 10, wherein:

(a) a throat of said reservoir extends into said annular portion of said second section.

12. The apparatus of claim 9, wherein:

(a) at least a portion of said first section extends upwardly from a wall portion defining at least a portion of said second section.

13. The apparatus of claim 9, wherein:

(a) said removable manifold is configured so that said removable manifold can be accessed and removed from the bottom-loading water cooler without removing the water storage bottle from the bottom-loading water cooler.

* * * * *